US005851149A

United States Patent [19]

Xidos et al.

[11] Patent Number: 5,851,149

[45] Date of Patent: Dec. 22, 1998

[54] DISTRIBUTED GAMING SYSTEM

[75] Inventors: John Xidos, Sidney River; Ross MacDougall, Halifax; David Carrigan, Bedford; Gary Hammond, Lower Sackville; Pamela Little, Eastern Passage; Bruce Reid, Bedford, all of Canada

[73] Assignee: Tech Link International Entertainment Ltd., Sidney River, Canada

[21] Appl. No.: 511,877

[22] Filed: Aug. 4, 1995

[30] Foreign Application Priority Data

May 25, 1995 [CA] Canada ..... 2150215

[51] Int. Cl.[6] ..... A63F 9/24

[52] U.S. Cl. ..... 463/42; 463/25; 463/26; 463/16

[58] Field of Search ..... 340/286.02, 825.06, 340/825.33; 395/200.01, 200.02, 200.09, 200.11, 187.01; 579/90, 91, 93, 94, 95, 96, 102, 105; 463/42, 41, 40, 25, 26, 27, 29

[56] References Cited

U.S. PATENT DOCUMENTS

| | | | |
|---|---|---|---|
| 4,455,025 | 6/1984 | Itkis | 273/237 |
| 4,467,424 | 8/1984 | Hedges et al. | 463/26 |
| 4,624,462 | 11/1986 | Itkis | 273/237 |
| 4,792,849 | 12/1988 | McCalley et al. | 379/105 |
| 4,802,217 | 1/1989 | Michener | 379/95 |
| 4,856,787 | 8/1989 | Itkis | 273/237 |
| 4,964,638 | 10/1990 | Ishida | 463/42 |
| 5,022,653 | 6/1991 | Suttle et al. | 463/27 |
| 5,038,022 | 8/1991 | Lucero | 463/25 |
| 5,048,833 | 9/1991 | Lamle | 463/27 |
| 5,191,410 | 3/1993 | McCalley et al. | 379/105 |
| 5,195,130 | 3/1993 | Weiss et al. | 379/90 |
| 5,197,094 | 3/1993 | Tillery et al. | 379/105 |
| 5,223,698 | 6/1993 | Kapur | 235/375 |
| 5,240,249 | 8/1993 | Czarnecki et al. | 463/11 |
| 5,265,874 | 11/1993 | Dickinson et al. | 463/25 |
| 5,280,909 | 1/1994 | Tracy | 463/42 |
| 5,283,734 | 2/1994 | Von Kohorn | 463/17 |
| 5,285,494 | 2/1994 | Sprecher et al. | 379/90 |
| 5,321,241 | 6/1994 | Craine | 463/25 |
| 5,324,035 | 6/1994 | Morris et al. | 463/42 |
| 5,340,119 | 8/1994 | Goldfarb | 463/18 |
| 5,367,561 | 11/1994 | Adler et al. | 379/91 |

(List continued on next page.)

FOREIGN PATENT DOCUMENTS

| | | |
|---|---|---|
| A524 709 | 9/1982 | Australia . |
| 1123948 | 5/1982 | Canada . |
| 1315401 | 3/1993 | Canada . |
| 2128715 | 6/1994 | Canada . |
| 2123857 | 11/1994 | Canada . |
| A 0 024184 | 2/1981 | European Pat. Off. . |
| 0 607 823 A1 | 7/1994 | European Pat. Off. . |
| A0 620688 | 10/1994 | European Pat. Off. . |

OTHER PUBLICATIONS

International Search Report, PCT/CA96/00328 (Jul. 30, 1996).

*Primary Examiner*—Jessica Harrison
*Assistant Examiner*—James Schaaf
*Attorney, Agent, or Firm*—Roylance, Abrams, Berdo & Goodman

[57] ABSTRACT

The Distributed Gaming System provides a user with remote location gaming, for example from within a hotel room. Using the room's television and a remote control, the user, such as a hotel guest, is able to play games similar to those available on a Video Lottery Terminal. The games are displayed on a TV through the use of a TV set-top box. The set top box connects the TV to a network of computer systems through which the Gaming System is distributed and managed. Game access is obtained using a payment swipe device. A special feature of system is the progressive jackpots that are available to game players; these jackpots are at the hotel, jurisdiction, and global levels.

95 Claims, 10 Drawing Sheets

U.S. PATENT DOCUMENTS

| | | | |
|---|---|---|---|
| 5,375,244 | 12/1994 | McNair | 395/187.01 |
| 5,396,546 | 3/1995 | Remillard | 379/105 |
| 5,457,305 | 10/1995 | Akel et al. | 235/379 |
| 5,475,625 | 12/1995 | Glaschik | 395/187.01 |
| 5,485,507 | 1/1996 | Brown et al. | 379/91 |
| 5,505,461 | 4/1996 | Bell et al. | 463/25 |
| 5,539,449 | 7/1996 | Blahut et al. | 379/90 |
| 5,558,339 | 9/1996 | Perlman | 463/42 |
| 5,564,700 | 10/1996 | Celona | 463/42 |
| 5,577,109 | 11/1996 | Stimson et al. | 379/91 |
| 5,583,918 | 12/1996 | Nakagawa | 379/91 |
| 5,602,905 | 2/1997 | Mettke | 379/91 |
| 5,605,506 | 2/1997 | Hoorn et al. | 463/47 |
| 5,608,800 | 3/1997 | Hoffman et al. | 395/187.01 |
| 5,611,730 | 3/1997 | Weiss | 463/40 |

DISTRIBUTED GAMING SYSTEM

FIELD OF THE INVENTION

The present invention relates to a local and wide area network system for gaming including a system of progressive jackpots that are available to game players; these jackpots are at the remote location, jurisdiction, and global levels.

BACKGROUND OF THE INVENTION

Gaming is an entertainment activity with an increasingly widespread availability involving numerous applications. Presently, gaming as a whole is a diverse industry implementing a large variety of systems that enable players to participate in various forms of electronic and video games.

In the past, gaming systems have been limited to localized networks and have not provided a widespread system for distributing and managing a sophisticated gaming network particularly within a hotel environment. Accordingly, there has been a need for a gaming system that integrates a plurality of individual gaming units into a distributed hierarchy of central and remote sites. Specifically, there has been a need for a distributed gaming system within a remote or hotel setting where a player accesses a gaming network through an in-room television set and remote control unit while using a credit card (or similar device) to obtain gaming credits, where the gaming system is established in a plurality of hotels, each of which are linked via a wide area network and a central network office.

Examples of past systems are disclosed, for example, in U.S. Pat. No. 5,038,022, which discloses an apparatus and method for providing credit for operating a gaming machine, U.S. Pat. No. 5,048,833, which discloses an apparatus for detecting a series of game outcomes including progressive jackpots, U.S. Pat. No. 4,467,424, which discloses a remote gaming system that enables a player's participation from a remote location, U.S. Pat. No. 5,283,734, which discloses a system and method of communication with authenticated wagering participation, Canadian Patent Application 2,123,857, which discloses an interactive, computerized gaming system with remote terminals, and Canadian Patent Application 2,128,715, which discloses a video gaming system with a fixed pool of winning plays and global pool access.

SUMMARY OF THE INVENTION

In accordance with the invention, a gaming system is provided, the gaming system comprising:

a plurality of local area networks (LAN's) for communication with a network operations server and a payment processing centre through a wide area network (WAN), each LAN including:

a plurality of set top boxes in remote locations, each set top box for communication with a back office server and respective televisions, remote control units, and payment swipe devices;

wherein the back office server includes program means for enabling interactive video gaming between a user and the television using the remote control unit wherein credit for said interactive video gaming is activated through the payment swipe device and approved by the payment processing centre through the WAN and where the network operations server is for communication with each LAN and for communication with the payment processing centre.

The invention also provides a gaming system enabling users to participate in gaming at a plurality of remote locations comprising:

a central network control center (NCC) interconnected to a plurality of gaming locations through a wide area network (WAN), each gaming location including a back office server interconnected through a local area network (LAN) with a plurality of gaming equipment in remote gaming sites, the central network control center including means for playing a jackpot.

In more specific embodiments of the invention, the system includes means for defining a hierarchy of jackpots, the hierarchy of jackpots having a first jackpot corresponding to each gaming location and a second jackpot corresponding to a plurality of gaming locations with the NCC including means for determining eligibility for winning the first and second jackpots.

The system may also includes means for defining a third jackpot corresponding to the gaming system and the NCC includes means for determining eligibility for winning the third jackpot.

In a preferred form, the means for determining the eligibility for winning includes a first, second and third betting threshold and the means for playing a jackpot includes a means for identifying a jackpot winner.

In a preferred form, the means for identifying a jackpot winner includes means for comparing a jackpot number generated by the NCC with a random number generated for a player at a game site during gaming.

The NCC may also include means for generating revenue reports, means for providing predetermined system access to a system regulator, means for receiving daily transaction logs from each remote gaming location, means for processing data from daily transactions logs to determine system daily revenue, and means for managing system software where the means for managing system software includes means for developing software, means for obtaining certification from a system regulator and means for distributing gaming software to each gaming location.

The NCC may also include means for managing system equipment, which includes means for installing equipment, means for tracking equipment and means for testing equipment.

The NCC may also include a customer support server, which includes means for providing customer support, means for identifying a gaming session, means for reviewing a gaming session, means for reviewing payment transactions.

The NCC may include tamper resist means, tampering recognition means, means for encrypting incoming and outgoing data, means for supporting a variable number of back office servers, and uninterrupted power supply means.

In another embodiment, the WAN includes a system regulator, the system regulator having means for accessing financial information from the central server, a payment processing centre and a bank server.

In a preferred embodiment the NCC and back office servers are UNIX platforms.

In a preferred form, the back office server includes means for providing a gaming session, which may include means for controlling access to a gaming session.

The means for controlling access may include means for restricting access to a gaming session, means for validating access to a gaming session.

A gaming session may include means for introducing a gaming session, means for playing a game, means for initiating a gaming session, means for monitoring game activity, means for closing a game session, and means for managing revenue.

A game may be selected from a variety of games such as, but not being limited to blackjack, poker or keno.

The back office server may also include back office server tamper resist means, tampering recognition means for identifying tampering, means for encrypting incoming and outgoing data, uninterrupted power supply means, means for receiving a payment transaction from remote gaming equipment, means for obtaining validation of a payment transaction.

In a preferred form, the remote gaming equipment includes a set top box, where the set-top box may include logic means defining an operating system, means for communication and equipment management, means for graphic generation and display, means for recognizing tampering, means for encrypting incoming and outgoing data, remote control signal recognition means, payment device signal recognition means for receiving signals from the payment device and for transmitting payment device data to the back office server.

In a preferred form, the set-top box communicates with the back office server via a transmission control protocol/internet protocol (TCP/IP) and includes tamper resist means.

In a further preferred form, the remote gaming equipment includes a television and a payment device which may be selected from any one of or a combination of a credit card swipe, debit card or smart card reader.

The remote gaming equipment may also include a video channel and a remote control.

The invention also provides a method of operating a gaming system comprising the steps of:

at a network control centre a) establishing a first jackpot amount with a corresponding betting threshold for a gaming location;

b) establishing a second jackpot amount with a corresponding betting threshold for a plurality of gaming locations;

c) establishing a third jackpot amount with a corresponding betting threshold for the gaming system.

d) determining first, second and third winning numbers for the first, second and third jackpots;

e) distributing the winning numbers to a back office server at each gaming jurisdiction;

f) providing gaming activity to players requesting game activity within each gaming jurisdiction;

g) monitoring gaming activity at the central server to identify active players and determining the eligibility of active players for winning in accordance with the betting thresholds;

h) generating a random number for each eligible player for a jackpot and comparing the random number to determine a winning player;

i) transmitting a message to a winning player informing the winning player of a win.

BRIEF DESCRIPTION OF THE DRAWINGS

These and other features of the invention will be more apparent from the following description in which reference is made to the appended drawings wherein.

DETAILED DESCRIPTION OF THE INVENTION

The distributed gaming system 10 in accordance with the invention provides a user, such as a hotel guest, with the opportunity to participate in gaming directly from a remote location such as a hotel room.

For the purposes of describing the system 10, reference is made to but not limited to a hotel environment.

Figure 1:
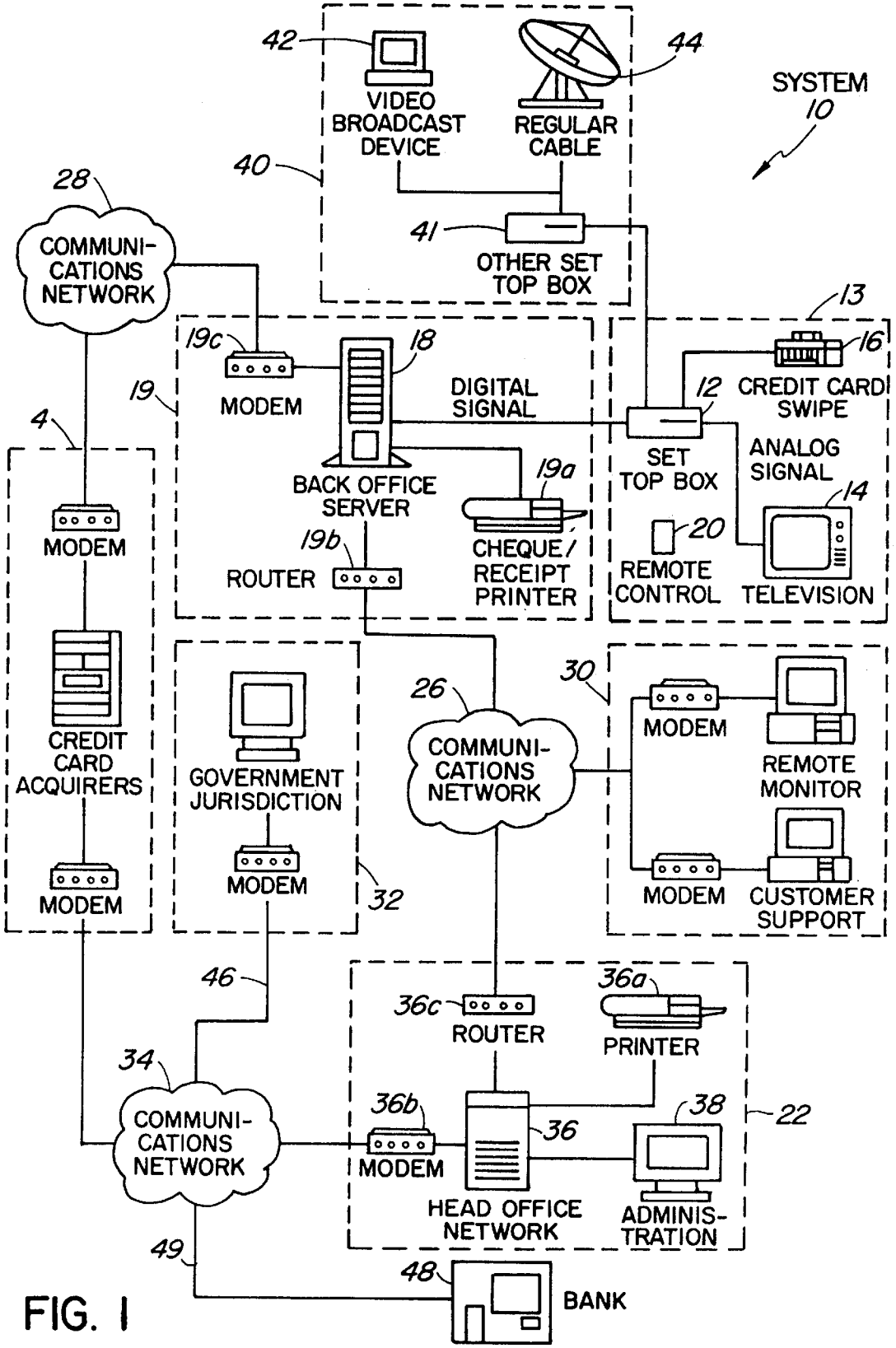
FIG. 1 is an overview of the distributed gaming system.

In addition to remote gaming, the system 10 also provides the user with the ability to access local, jurisdictional and global jackpots directly from their hotel room. As shown in FIG. 1, the distributed or hotel gaming system includes a set-top box 12 in a hotel room 13, the set-top box 12 in communication with a television 14, payment device 16 and back office server 18 centrally located in a hotel office 19. A remote control unit 20 enables a player to interact with the gaming system 10. The back office server 18 is in communication with both a network operations centre 22 and a payment processing centre 23 through communications networks 26 and 28 respectively. The system 10 may also include player support centre 30 and monitoring centre 32. The monitoring centre 32 may communicate with both the network operations centre 22 and payment processing centre 23 through communications network 34.

In accordance with another embodiment of the invention, the system 10 may also include a broadcast channel facility used for broadcasting promotional information to each room.

As indicated above, each hotel room 13 within the hotel gaming system 10 contains a set-top box 12, television 14, remote control 20 and payment device 16. The payment device 16 is preferably a credit card swipe device. Each set top box 12 is identifiable by a unique unit number for the purposes of identifying its location within the system 10. As each set top box 12 is connected to the system 10, its room number (that is, location) is recorded with the associated communication channel to which it is connected.

At the central Network Operations Centre 22, monitoring systems within a head office server 36 and administration computer 38 check all set-top units 12 connected to the system 10 and ensure that units 12 can receive and transmit properly. When a malfunction is detected, as the result of mechanical failure or deliberate tampering by unauthorized person(s), a message alert is issued to the operational staff at the network operations centre 22. The operational staff investigates and takes the appropriate steps necessary to resolve the problem.

General Operation of the Hotel Gaming System

In order to describe the hotel gaming system 10, herein follows a general description of the operation of the system 10 within a typical environment in which the hotel gaming system 10 may be deployed. It is, however, understood that the particular video format or presentations described herein are only representative of potential deployment formats and are not intended to limit the scope of this invention.

With the remote control unit 20, the hotel guest turns on the television 14 and tunes the set to the channel identified as the gaming channel. By pressing any channel button, the customer can move to and from the gaming channel.

Upon entry to the gaming channel, the player observes a promotional broadcast detailing the various features of the hotel gaming system including a presentation of the gaming system functions and special notices regarding past winners and special events.

Upon conclusion of the greeting, the player is presented with the first of three Game Tutorials available. The Game Tutorial presents the rules of each game and a game simulation. When the Game Tutorial ends, the player is presented with an option to enter a Free Play game mode. Alternatively, the player can proceed immediately into actual Game Play or exit the Gaming Channel. The player presses the Game Mode button to choose either Free Game mode or actual Game Play; to exit the Gaming Channel, the player uses the television remote to change the channel. In Free Play, the game is set-up with a limited number of credits that can be used to simulate game activity. The player executes the game repeatedly, until game credits are reduced to zero or a predefined time period has elapsed.

At any time, the player can proceed to actual Game Play, by pressing the Game Mode button until Game Play mode is established. The player is instructed to pass a credit card through the credit card swipe device 16; this process establishes a Game Session for the player. Using designated buttons located on the remote control unit 20, the player sets the amount to be approved for Game Play. The television set 14 displays the card information and shows the amount set by the player. When the player has set the amount, a button is pressed to approve the amount and a request for card approval is transmitted to the payment authorization centre 24 for authorization. When authorization is received back from the payment processing centre 24, the Game Session is provided with the funds and the associated Game Credits to be used during Game Play. Should authorization not be received from the payment processing centre 24, the player is advised with an explanatory message which includes the appropriate contact for Player Support.

Once Game Credits are obtained, the player can play any one of the games available, such as draw poker, 8-liner, keno or blackjack. The player selects a Game by pressing a button located on the remote control unit 20. The Game is activated and displayed on the television screen. The player uses the Remote control unit 20 to set a bet amount; the bet amount remains in place for the duration of the Game, unless specifically changed by the player.

For purposes of this general description, the player selects Game 1 determined to be Draw Poker.

After setting the bet amount, the player uses the Deal/Draw/Spin button to start the game hand. Five cards are dealt to the player and these are displayed; using the buttons marked Card 1 to Card 5, the player designates card(s) to be held. To unhold a card, the designated Card button is pressed again; alternatively, the player may unhold all cards by pressing the Cancel button. After selecting the cards to be held, the player presses the Deal button again and the game results are presented; the credits won or lost are reflected in the Game Credits. At this time the player may change to another game, change the bet amount and/or continue with the current game.

During a subsequent game hand, the player receives a message that Game Credits are insufficient for the bet amount set; the player can reduce the bet amount or, alternatively, can chose to obtain additional funds. To obtain additional funds, the player passes the credit card through the credit card swipe device; as before, the player uses the designated keys to define a amount and transmit for approval. Once approved, the game session credits are increased and the player can continue with Game Play.

To end the Game Session, the player presses the Payout button. The television screen displays a summary of the session activity, including a summary of credit card transactions plus any Payments owed to the player. The summary informs the player where Payments and transaction receipts can be picked up, usually the hotel front desk.

While viewing the game display, the player sees notices of the various jackpots in operation and the current amount of the jackpots available to win; as the player watches, the jackpot amounts increase.

Jackpot Eligibility

During Game Play, as the player increases the bet amount, the hotel jackpot is visibly highlighted; when the player increases the bet amount again, the jurisdictional jackpot is highlighted and when the bet amount is increased further, the global jackpot is highlighted. The player has become eligible to win any one of the three jackpots available. As or when the player reduces the bet amount, the player becomes ineligible for one or more of the jackpots, based upon the bet amount. When a player is not eligible for a jackpot, the jackpot display is not highlighted.

Play continues. After some time, there is a message that the player is one of the winners for the stipulated jackpot. The message provides the player with a verification number and advises the player to contact the network operations office 22 to receive the jackpot award.

The player contacts network operations office 22 and provides sufficient information to confirm the win; arrangements are made by the player to receive the payment.

Player Support

As indicated above, the system 10 may also be provided with a player support centre 30 to answer inquiries or questions from players. A description of the player support centre function is described below:

The player support centre 30 receives telephone calls preferably on a 1-800 number available at all locations of the Hotel Gaming System. Upon receiving a call from a player, Player Support requests the unit number of the game device located at the site and the player's card number. Once obtained, both the unit and card numbers are entered into an on-line application available at the Player Support workstation. The application displays information regarding the game session and equipment status. Player Support is able to determine whether the game session is one currently in-progress or is one which was previously closed. If the game activity took place prior to the past twenty-four (24) hours, Player Support is presented with the player's card transactions only.

Review Session Activity

Assuming that the game activity took place within the past twenty-four (24) hours, Player Support can request a review of the games played. When requested, Player Support is presented with the player's past five (5) game hands. Player Support walks through the game activity with the player, and views what the player sees (or would see, if this relates to a past game session) at the player's location.

Review Card Transactions

In addition to game activity, Player Support can query the players' credit card transactions. Using the players' card number, Player Support enters this into an on-line application and the related credit card transactions are listed with associated card holder name. Player Support requests from the caller additional information in order to validate the caller against the card holder. Once the caller's identity is validated, Player Support uses the card transactions to address the caller's question Game Access Certain hotel guests may not wish to have the gaming device accessible to their room; this is accommodated by a call to Player Support or to the hotel front desk. Player Support will ask for the device terminal number and the time period that the device should remain unavailable.

Game Payments, Transaction Receipts

Game payments to a certain limit and transaction receipts are printed within the hotel using a printer accessible to hotel staff. Each payment and transaction receipt contains the card holder number to whom the payment/receipt belongs. Upon check out or when requested, the hotel staff provides these to the player.

Regulators

All gaming activity is recorded specifying the jurisdiction, hotel, and game device where the game activity occurred. Regulators for each jurisdiction are able to log into the system 10 and access records of gaming activity pertaining to its jurisdiction. Periodic reports are provided to the jurisdictional authorities in compliance of local gaming regulations and standards.

Administration at the Network Operations Centre 22

Game Administration

At the conclusion of each business day, the network operations office 22 offices receive transmissions of all game activity and card transactions. The credit card transactions are bundled and electronically transmitted to the card approver 24. The same card transactions are used to calculate the days' revenue. From the calculated gross revenue, funds are distributed to the various hotels, jurisdictions, and jackpots. In calculating the revenue distribution, the gross revenue for the applicable area is used.

As an example, ten percent (10%) of the gross revenue is distributed to the jackpots; two percent (2%) of a hotel's gross revenue is returned to the hotel jackpot, three percent (3%) of the jurisdictions' gross revenue is distributed to jurisdictional jackpot, and five percent (5%) of total gross revenue is distributed to the global jackpot.

Statistics obtained from the game activity may be used for analysis of the Gaming System; these statistics enable assessment of game activity by the network operations office 22 and the jurisdiction.

Jackpot Management

As indicated above, the Hotel Gaming System 10 preferably incorporates progressive jackpots within Game Play; these jackpots are available to players involved in active game play with defined bet amounts. Each level of jackpot (hotel, jurisdiction, global) has its own eligibility requirement; the higher levels of jackpots have corresponding increased eligibility requirements.

When the Hotel Gaming System 10 is introduced to a new jurisdiction, the jackpot is defined with the relevant information. The network operations office 22 staff enter the applicable jackpot bet amount for the jurisdiction and seed the jackpot with a initial amount; this initial amount is recovered from the funds allocated to the Jackpots.

Jackpot Calculation

Daily, within the system 10 , jackpot numbers are established for each of the jackpots. Once derived, the numbers are electronically transmitted to local sites where the hotel gaming system has been installed. Each number is date and time stamped indicating the date and time when the number becomes active. A high level of security is used for the generation, transmission and storage of jackpot numbers.

Using the network, monitoring applications within the system scan gaming activity and identify players who are eligible for one or more of the jackpots. Each time a player is determined to be eligible, the network operations centre 22 assigns a random number and matches it to the jackpot number. When a match is made, the central office 22 receives a message transmission indicating the jackpot has been won, the jackpot amount is then reset for the next day.

Jackpot Awards

At the conclusion of the business day, after the day's revenue is calculated and distributed, the network operations office 22 updates the current jackpot balances. Once updated, the number of jackpot winners (if any) of each jackpot is determined. For each jackpot won, the jackpot amount is divided by the number of winners and payments are created for each winner.

When a jackpot is awarded, the network operations office 22 resets the jackpot balance to the amount defined at the time the jackpot was established.

The network operations office 22 releases a jackpot payment when contacted by the player; to validate the payment, the network operations office 22 utilizes the unique verification reference number provided to each player when the jackpot was won.

Restricted players

Occasionally, the network operations office 22 must restrict a specific individual from the Hotel Gaming System 10. At the network operations office 22, staff enter the card holder number as a restricted card; any attempts by the card holder to use the system will result in them receiving a message to contact the network operation office for further information about the restricted card.

COMMUNICATIONS DESIGN

Overview—Communications Design

This section describes a preferred high-level communications network design showing processor nodes, the data and processes allocated to each node, and the communication conduits allocated between nodes. Basic assumptions are used to estimate the data traffic volumes.

Figure 2:
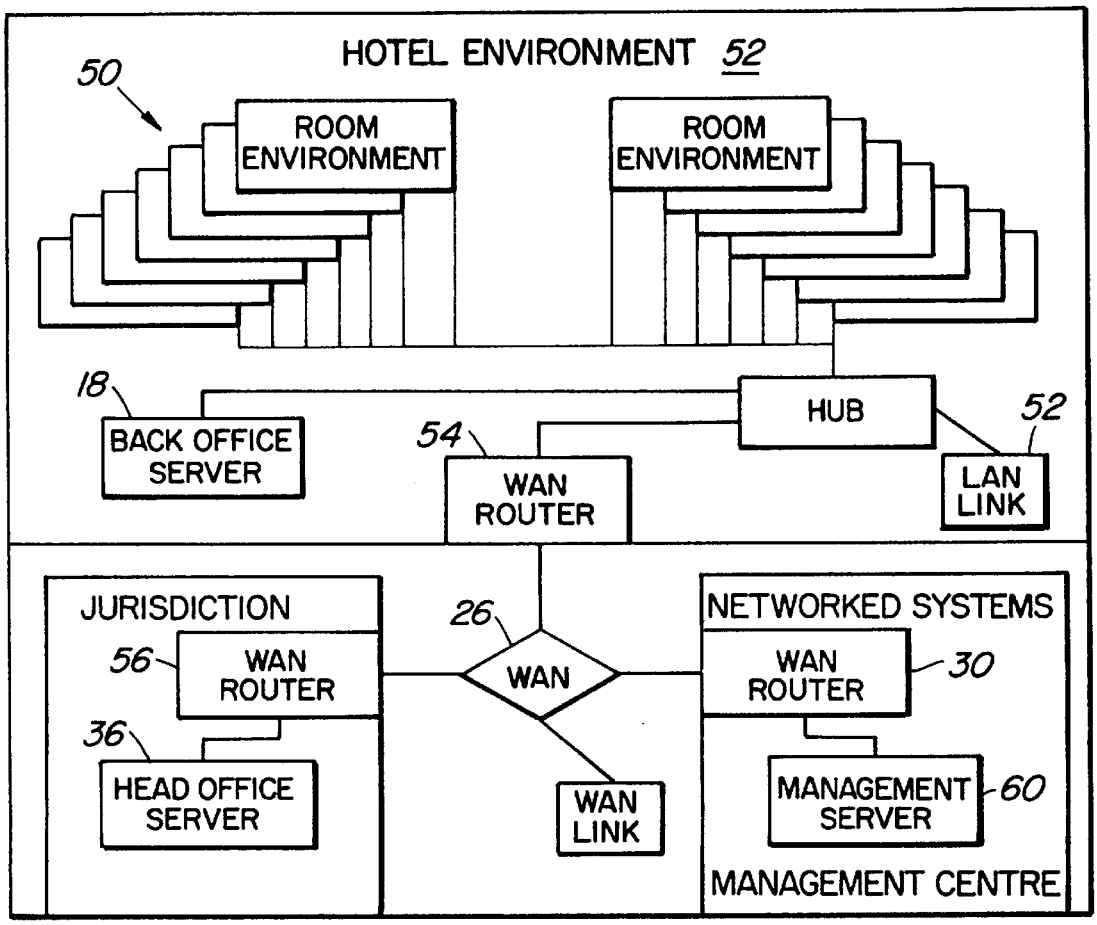
FIG. 2 is a typical communication topology of the distributed gaming system.

FIG. 2 illustrates a typical communication topology 50 in accordance with the invention. The communication topology includes the local hotel environment 52 with local area network link 53, back office server 18, wide area network router 54, wide area network 26, a jurisdictional WAN router 56 in the network operations centre 22 and WAN router 58 and management server 60 in the management centre 30.

Communication Conduits

Within the system there are three major communication conduits and three minor communication links. The first major conduit is the LAN conduit which connects the rooms 13 to the Back Office Server 18. The second major conduit is the WAN conduit connecting the various Hotel environments with the Network operations Server 36 and the Networked Systems Management Centre 30. The third conduit is a promotional channel conduit 40 which would be used to broadcast promotional information to each room. The first minor link is a link between each server and the selected credit card acquirers. The second link is a link between the local gaming jurisdiction and the local Network operations Server. The third link is between the Network operations Server and a bank for cheque reconciliation.

LAN Conduit

The LAN Conduit supports the communications between the hotel room Set Top Boxes 12 and the Back Office Server 18. It is contemplated that this link can take one of two forms.

The first form utilizes cable modems to communicate with the back office server 18. A number of set top boxes 12 share a cable channel and form a communication segment.

The second form utilizes a more standard computer LAN topology. This topology utilizes standard network equipment providing high flexibility in hardware sources and conduit segmenting.

In either case it is recommended that TCP/IP be used as the transport with the back office server 18 allocating TCP/IP addresses to the Set Top Boxes 12 at session commencement. These TCP/IP addresses do not have to be registered as Internet devices as long as the Back Office Server acts as a Fire Wall between the LAN traffic from the WAN traffic. (Fire Wall—a security method that blocks all traffic between two segments of a LAN or WAN.) (IP from TCP/IP corresponds to the Internet Protocol. The addresses for people on the Internet are allocated from a group in the United States. Anyone can use IP but it must be Fire Walled, restricted from, the Internet unless all addresses being used are registered.)

WAN Conduit

The WAN Conduit supports the communications between the various hotels, the Network operations server(s) and the Remote Management Site 30. It is recommended that this conduit take the form of a router based packet switched network. The network itself can take the form of ATM, Frame Relay or X.25 depending on cost and performance. The link utilizes standard WAN networking hardware providing the highest availability of the equipment, support and security tools. The transport over this WAN should be TCP/IP encapsulated in the appropriate WAN protocol (ATM, Frame Relay or X.25). As an option dial, routers can be used where the WAN requirement is limited.

Promotional Channel Conduit 40

The Promotional Channel Conduit is contemplated as a single cable channel over which a promotional video or similar message is broadcast. This Conduit utilizes a small system 41 and a channel specific broadcast unit 42 to place the signal on the existing hotel cable network 44.

Credit Card Link 28 and 34

It is contemplated that two types of links are required to the Credit Card Acquirer. The first link 28 is a dial-in or dedicated link (depending on traffic) from the Back Office Servers 18 and the Credit Card Acquirer 24. This link is used to request credit approval in real time as part of game play. The second link 34 is between the Network operations Server 36 and the Credit Card Acquirer 24. This link is used to transmit credit card transactions in the form of batches. Standard communications methods are used. The specific standard is defined by the financial institution.

Remote Control Unit 20

With respect to the Remote control unit 20, it is preferred that the remote control unit has the following function buttons to facilitate game play:

game mode—to activate the game device tutorial—to activate the tutorial presentation payout—to request an end of session game selection buttons—to select a specific game 5 card buttons—to hold a card in a draw poker game bet—to change the bet amount review—to review the last 5 hands/spins cancel—to cancel the last action deal/draw/spin—to initiate the play action Jurisdictional Link 46

The second link is between the Network operations Server 36 and the Local gaming jurisdiction 32. This link is a dial-in/out link which allows the Network operations Server 36 to download reports and statistics and the local Gaming Jurisdiction to audit the Network operations System. It must be emphasized that with a dial-in link, security in the form of access verification should be strictly enforced using such methods as challenge and response or passwords. Standard communications methods are contemplated with the specific standard defined by the jurisdiction.

Bank Link 49

The third link is between the Network operations Server 36 and a bank 48. This link is contemplated as a dial-out link which would allow the Network operations Server to transmit cheque issue files for account reconciliation. Standard communications methods would be used and would be defined by the financial institution.

Data traffic Estimates

LAN Conduit

The LAN conduit is contemplated as an on-demand type of utilization which is based on the number of players and their activity at any point in time. To determine the data traffic estimates the following assumptions were made:

Average hotel size was 500 rooms.

20% of the guests use system each day.

Peak utilization represents 80% of that days users.

A session represents 1095 transactions per hour.

A transaction averages 256 bytes (2048 bits).

Therefore, the required bandwidth for the peak period would be:

$$\frac{2048 \times 1095 \times 80}{60 \times 60} = 49{,}835 \text{ bits per second}$$

WAN Conduit

The WAN conduit is primarily a scheduled type of utilization with a minimal requirement for real time on-demand traffic. In that the largest volume of traffic would be during the transmission of a days transaction log from the Back Office Server to the Network operations Server, the real-time traffic would take the form of the traffic required for remote management and for jackpot reconciliation. To determine the traffic estimates the following assumptions were made:

Average hotel size is 500 rooms.

219,000 records per day.

A transaction averages 256 bytes (2048 bits).

Time to complete a back-up must not exceed 4 hours.

100 Hotels report into a single Network operations Server

Therefore the required conduit out of a hotel site would be:

$$\frac{219{,}000 \times 2048}{4 \times 3600} = 31{,}147 \text{ bits per second}$$

and the required conduit into a Network operations site would be:

$$31{,}147 \times 100 = 3{,}114{,}700 \text{ bits per second}$$

Credit Card Link 28 and 34

The Credit Card Acquirer Link is contemplated as an on-demand link between the Back Office Servers and the acquirer and a scheduled batch processing link for the Network operations connection. For the Back Office Server connection, a medium to low speed modem could be used (2400 to 9600). This is possible as the amount of data to be transferred is small. For the Network operations Server connection, it is recommended that a higher speed modem be used (14400 to 28800) to handle a higher volume of transactions.

Jurisdictional Link 46

The Jurisdictional link is contemplated as a scheduled high security link. This link would require medium to high speeds (9600 to 28,800) with an access control security system. Dial back and user authentication is recommended.

Bank Link 49

The Bank link 49 is contemplated as a scheduled high security link requiring medium to high speeds (9600 to 28,800) with an access control security system. Dial back and user authentication is recommended.

Communication Limitations

The link speed between the Credit Card Acquirer 24, the Jurisdiction 32 and the Bank 48 and the Back Office 18 and Network operations servers 36 is limited by the speeds supported by the Acquirer 24, Jurisdiction 32 and Bank 48.

The format and content of the communications between the Credit Card Acquirer 24, the Jurisdiction 32 and the Bank 48 and the Back Office 18 and Network operations servers 36 will be defined by the Acquirer 24, Jurisdiction 32 and Bank 48.

A single LAN segment can typically support up to 1000 devices. Larger hotel sites require multiple LAN segments.

LANs have a limited distance. Repeaters or hub (which act as repeaters) may have to be distributed to each floor or every other floor. A fiber-optic backbone may also be a consideration for some sites.

As TCP/IP addresses are allocated from a central site, unless the IP addresses used by this system are registered, it is recommended that they be fire walled from the Internet.

It is also assumed that extra pairs of existing telephone cable could be used as the physical transport. If these do not exist or the quality is unacceptable new cabling may have to be installed.

Figure 3:
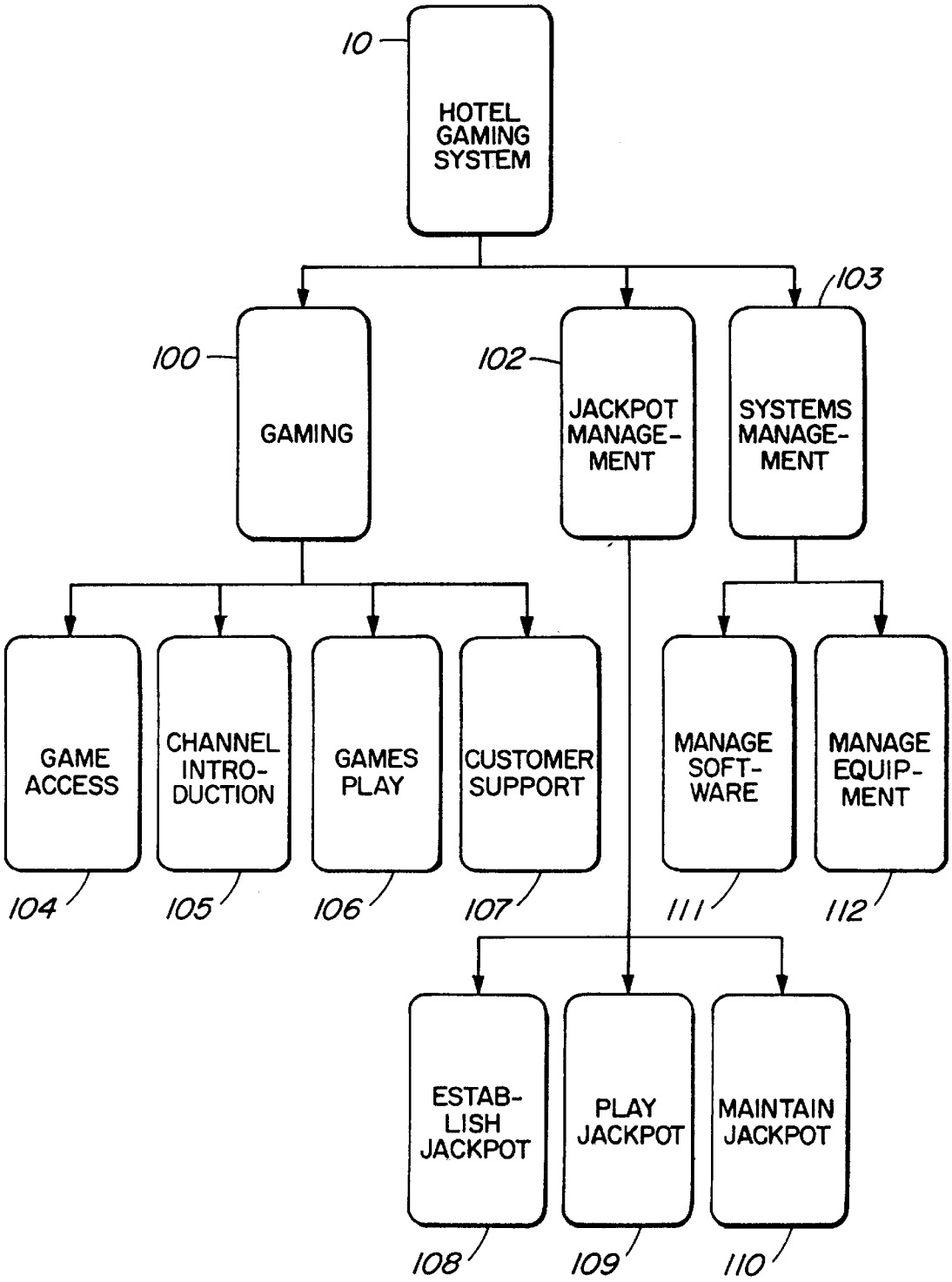
FIG. 3 is an overview of the process model of the distributed gaming system.

FIG. 3 is an overview of a Process Model which defines a typical relationship between the major processes performed by the hotel gaming system 10.

PROCESS MODEL

The three (3) major processes are:

Gaming 100;

Jackpot Management 102; and

System Management 103.

Each of these is broken down further into key processes including game access 104, channel introduction 105, games play 106, customer support 107, establish jackpot 108, play jackpot 109, maintain jackpot 110, manage software 111, and manage equipment 112 which are described in further detail below. In a preferred embodiment, the system 10 is designed to accommodate the presentation of textual information to the player in multiple languages.

Game Access Process 104

Figure 4:
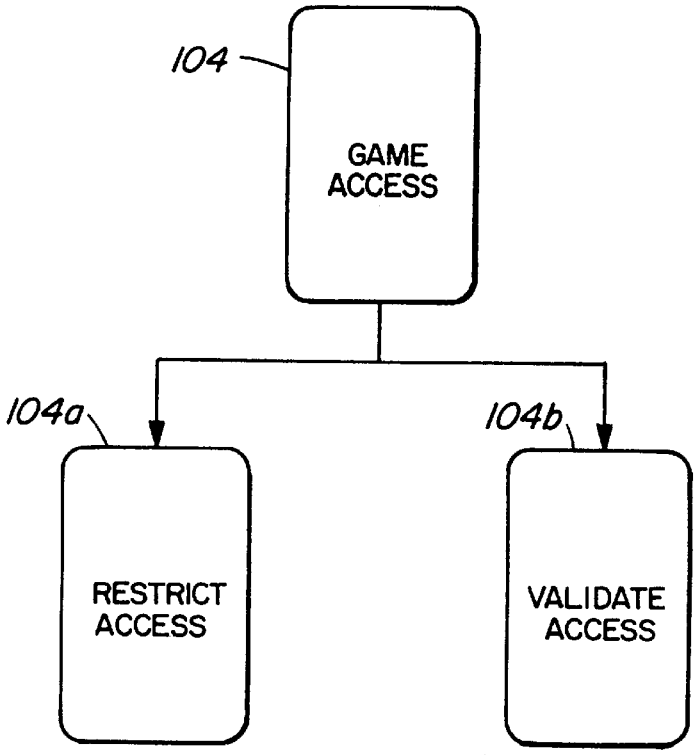
FIG. 4 is an overview of the game access process.

With reference to FIG. 4, Game Access Process 104 is described which includes sub-processes Restrict Access 104a and Validate Access 104*b*.

Restrict Access 104*a*

This process creates a restriction to game access from a set top box location. The restriction is imposed upon the request of the hotel room patron and would be performed by Player Support Staff.

Validate Access Process 104*b*

This process checks for an access restriction applied against a set top box. If a restriction is encountered, all functions of the gaming system remain inoperable at that location. If no restriction is present, the gaming functions are activated.

Introduce Game Channel Process 105

Figure 5:
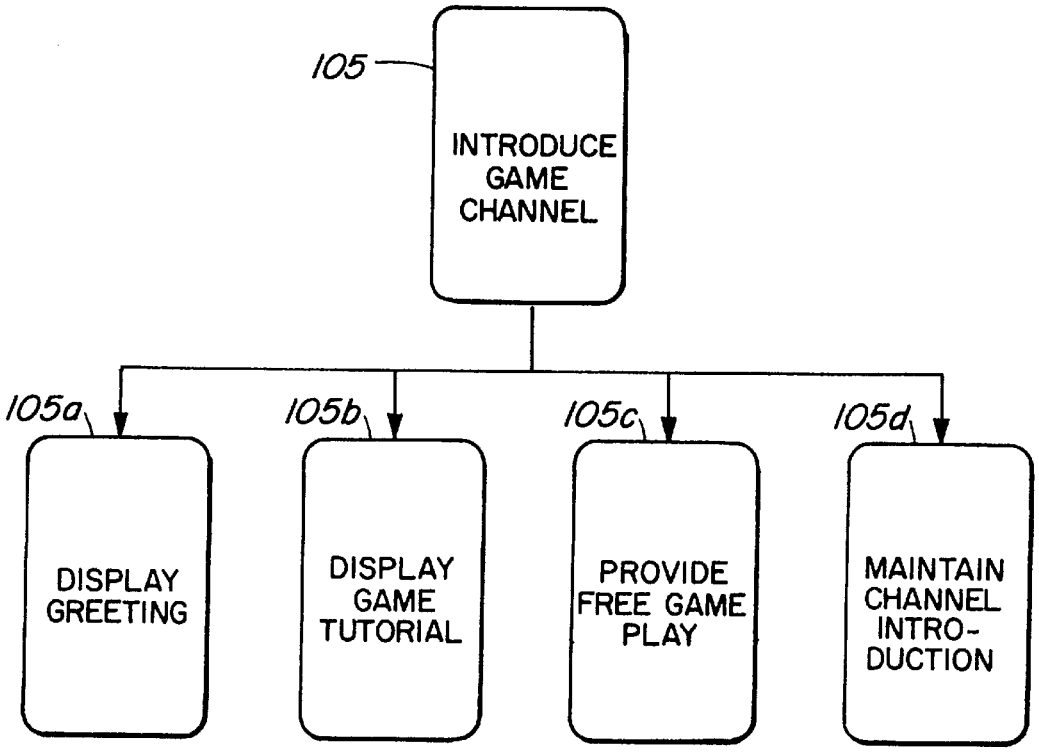
FIG. 5 is an overview of the channel introduction process.

With reference to FIG. 5, Channel Introduction Process 105 is described which includes sub-processes Display Greeting 105*a*, Display Game Tutorial 105*b*, Provide Free Game Play 105c and Maintain Channel Introduction 105*d*.

Display Greeting Process 105*a*

This process presents a variety of promotional material to the channel viewer; these may include:

Channel Promotion; a multimedia promotion of the gaming channel prepared by an external agency;

Winner Interviews; a series of zero, one, or more interviews with game and/or jackpot winners, prepared by an external agency; and Special Event Notices, a composite of textual information entered by company management and/or identification of game and/or jackpot winners.

The display greeting process 105*a* is initiated when the television set is tuned to the gaming channel. Each form of the promotional material is presented in sequence, before advancing to the Game Tutorial. At viewer request, this process can be cancelled; if cancelled, the viewer may leave the gaming channel, may proceed to a game tutorial, or begin game play.

Display Game Tutorial Process 105*b*

After the Channel Introduction, a tutorial for each game may be presented in sequence; the game tutorial details game rules and demonstrates game play. The viewer may select a specific tutorial to be viewed.

Provide Free Game Play Process 105*c*

This process allows the viewer to sample the game through game play. The game play enables the play to simulate game activity. Simulation mode allows no credits in or credits out of the game; nor is the game play considered for jackpot eligibility. The duration of free play may be limited to a maximum duration in accordance with jurisdictional guidelines, for example, five (5) minute duration per game.

Maintain Channel Introduction Process 105*d*

Revisions to each form of the Channel Introduction can be implemented independently of another and may include special notices. Special notices may include promotional and/or informational text; and/or lists of defined game and/or jackpot winners. The list of winners would be selected from winner files based upon one or more criteria defined during preparation of the notices. The selection criteria would include, but may not be limited to the amount won, the type of win (game and/or jackpot) or the level of win (top 'n' percentage, where 'n' represents the percentage range).

Games Play Process 106

Figure 6:
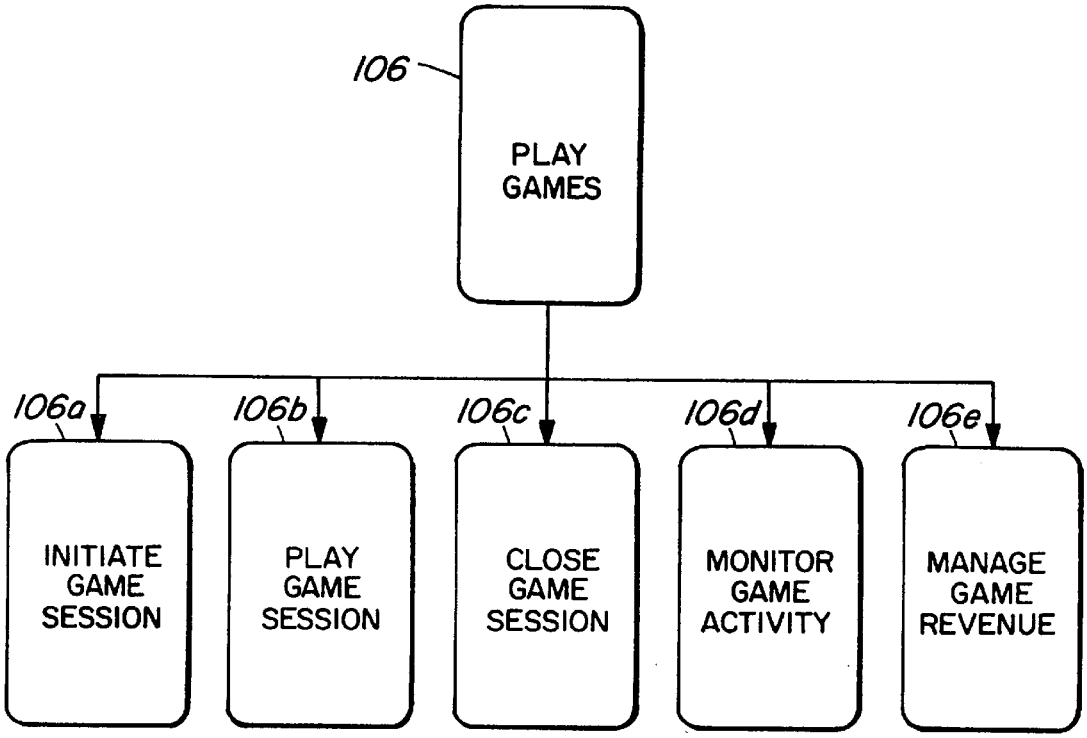
FIG. 6 is an overview of the games play process.

With reference to FIG. 6, games play process 106 is described which includes sub-processes initiate game session 106*a*, play game session 106*b*, close game session 106*c*, monitor game activity 106d and manage game revenue 106*e*.

Initiate Game Session Process 106*a*

This process is activated by a credit card swipe. Before establishing a game session, the card holder number is matched against an internal file at network operations centre 22 defining restricted card numbers. If the card number matches one of the restricted numbers, the card holder is advised and access to game play is disallowed.

If the card number is not restricted and a session does not currently exist for the card holder, a game session is created and game player requests credit card funds approval. A Request for Approval credit card transaction is created and transmitted to the payment processing centre 24; the payment processing centre 24 returns the transaction with an approval code. When the approval code is received, the credits available for game play are calculated. If no approval code is received, the player is notified and the game session is ended.

A minimum amount would normally be required to initiate a game session.

Play Game Session 106*b*

This process enables a game to be selected and played. This process may allow the resumption of a game session; if so, the last recorded position of the game session is restored. If the game session was previously open, Game Session credits and previous session status are re-established. During Play Game Session, the player selects and executes one or more games. Within the game play, the player defines the bet amount. The player will interact with the game through remote control unit 20.

Game session credits are used for game play; credits earned or resulting from game activity are known as credits won. When a player starts game play, the bet amount reduces the Session Credits. At the end of a Game, the credits won (if any) are added to the Session credits. This process records the game activity for individual game hands and includes beginning Session Credits, credits played, credits won/lost, and resulting Session Credits.

When Session credits are reduced to zero, the player must obtain additional credit card funds before further game play can occur. Alternatively, the player may inactivate the Game Session or cash-out.

Within a Game Session the player is able to review game hands previously played; preferably a minimum of 5 games would be available for viewing. In one embodiment, the display of the last 5 hands may be presented as small screen images shown on one screen. Similarly, game bonus points which accumulate over games and game sessions, game credits, pay tables, and bet amount are preferably visually separate to enable the player to focus on game activity. It is also preferable that high quality sound and visual graphics are provided. With respect to the bet amount, it is preferable that the bet amount may be changed during game play and be retained between game hands but is not retained when a player changes the game being played wherein the default bet amount is set to zero.

If no game activity occurs within a stipulated time period, the status of a Game Session would be turned inactive.

Close Game Session Process 106*c*

This process closes a game session for a player. A game session may be closed in response to any one of the following events:

- the card device is swiped with a different card than previously used
- the player has requested pay-out
- 24 hours has elapsed since game event was previously logged When a session close is the result of a different card being passed through the card swipe, the existing session will close automatically if that session holds no outstanding credits. If the existing session does have credits then, the player is issued a warning indicating an open session exists. The player is requested to confirm the session close. When confirmation is received, then the session is closed; if no confirmation is received, the existing session remains operational.

When a game session is closed, the player status is determined. If the player has not used all Game Session credits, these are applied against the credit card by the creation of Reversal of Card Approvals. If remaining Game Session credits are insufficient to cover approved funds, debit transactions are created for approved transactions not reversed. A transaction receipt is issued for all credit card debits. If, after all credit card transactions have been covered, there remains Game Session credits; a payment is created for the amount outstanding. The payment is printed at either hotel, jurisdictional office, or at the central site, depending upon the payment amount.

The summary of financial activity is presented to the player, including any credit card transactions to be applied against the card holder account and any payments due to the player.

Monitor Game Activity Process 106*d*

This process provides statistical and information reports to track game activity and provides data access to appropriate regulatory bodies. Input to this process is game activity recorded during the process Play Games.

Reports that show total credits played, total credits awarded, and average credits played per game can be provided. The reports may be broken down by jurisdiction, by game, and by equipment.

Manage Game Revenue Process 106*e*

This process calculates gross and net revenue resulting from all closed game sessions. Credit card transactions are transmitted to the payment processing centre and card transactions are reconciled against funds received from the card approver. Payments are reconciled against payments issued and cashed. Payments that are owed but for which no payment has been issued are tracked as unclaimed funds. Payments that are unclaimed for a period greater than one (1) years are changed to revenue and included within the next revenue calculation, subject to regulatory approval.

After revenue has been calculated, the distribution of revenue to jackpots, hotels, jurisdictions, and company is calculated and issued. Each jurisdiction and jackpot receives a percentage of gross revenue obtained from their area of play; that is, the revenue received from jurisdiction 'A' is used for revenue distribution to jurisdiction 'A'.

All regulatory and/or governmental reporting regarding game revenue and payments is done within this process.

Distribution of revenue is based upon funds received within the distribution area. The Global Jackpot is based on funds received from all Jurisdictions.

Unclaimed funds are tracked; unclaimed funds are payments owed to a player and for which payment was not issued, nor requested.

Player Support Process

Figure 7:
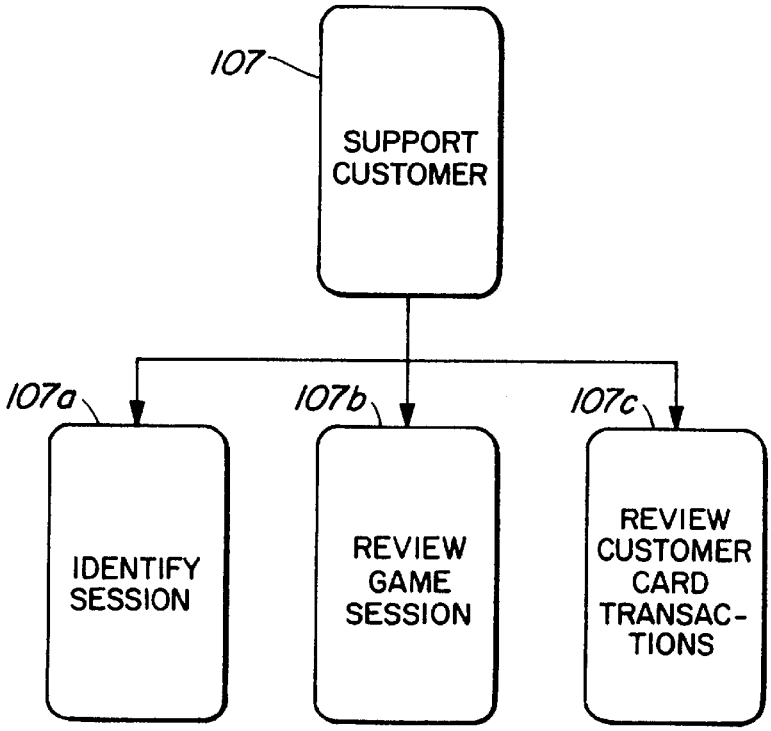
FIG. 7 is an overview of the player support process.

With reference to FIG. 7, player support process 107 is described which includes sub-processes identify session 107*a*, review game session 107*b* and review customer card transactions 108*c*.

Identify Session Process 107*a*

This process is performed by player support representative when a player calls with a problem related to an open Game Session. The player provides equipment information and this is used to locate network information about equipment in use at the player location. Once equipment is identified, the player support representative can identify the game session and determine both the equipment and game session status.

Review Game Session Process 107*b*

This process is executed by the player support representative to access open game sessions and display previous game play and/or game session activity. The game play viewed is the same information viewed by the player; preferably, a minimum number of five(5) game hands can be viewed by the player and therefore, player support.

Review Player Card Transactions Process 107*c*

The player support representative uses the card holder number to locate all related card transactions. The player support representative is required to query the caller and verify card ownership before releasing any details related to the card transactions. The player support representative, with appropriate approval, may reverse a debit transaction; this would create a debit reversal transaction that will be issued against the card holder account.

Establish Jackpot Process 108

Figure 8:
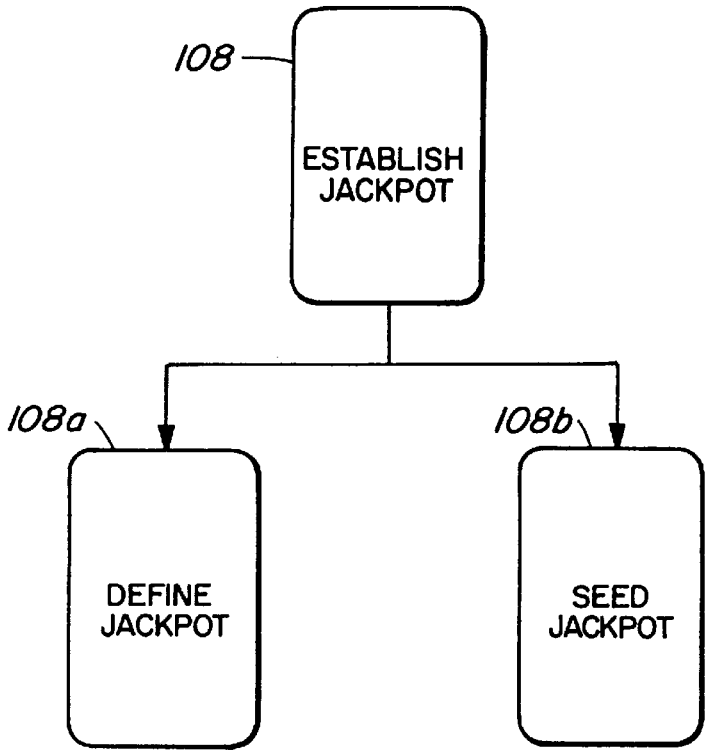
FIG. 8 is an overview of the establish jackpot process.

With reference to FIG. 8, Establish Jackpot process 108 is described which includes sub-processes define jackpot process 108*a* and seed jackpot process 108*b*.

Define Jackpot Process 108*a*

This process is executed once, whenever a new hotel and/or jurisdiction has a jackpot and game play approved. Each jackpot is described as to location and player eligibility requirements. In accordance with the invention, a jackpot is preferably identified as one of three types including hotel, jurisdiction or global. There is one(1) global jackpot and a separate jackpot for each jurisdiction and for each hotel. Each hotel jackpot must be associated to a single jurisdiction.

Seed Jackpot Process 108*b*

This process places a predetermined amount into a newly defined jackpot.

Play Jackpot Process 109

Figure 9:
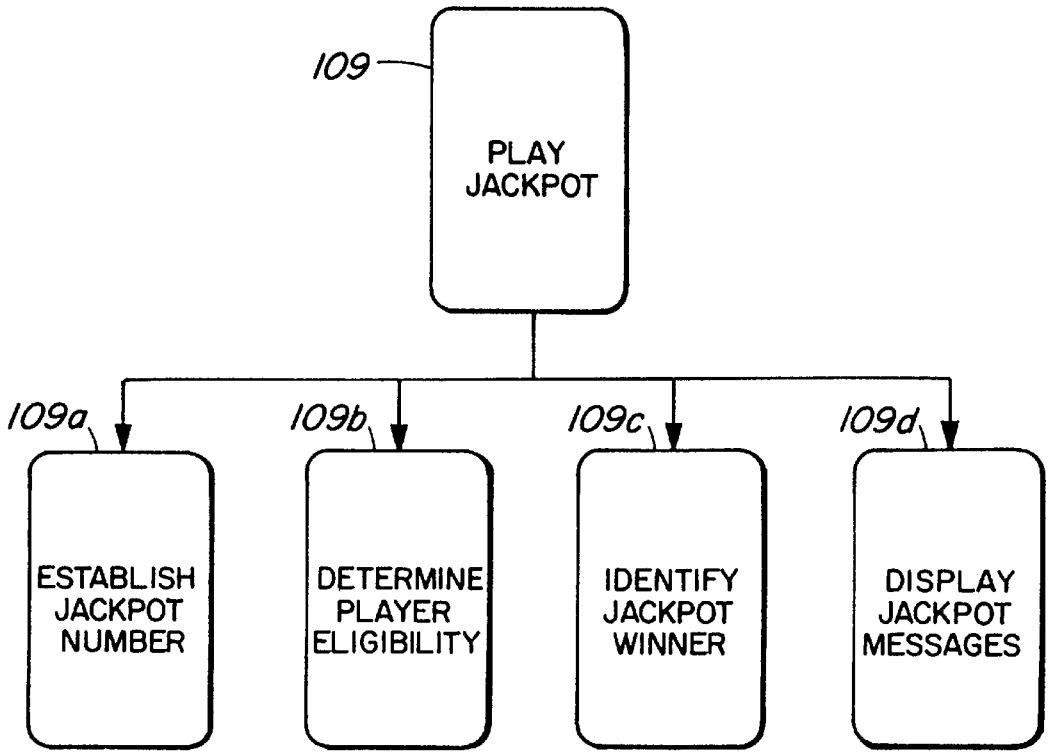
FIG. 9 is an overview of the play jackpot process.

With reference to FIG. 9, a Play Jackpot Process 109 is described which includes sub-processes establish jackpot number process 109*a*, determine player eligibility process 109*b*, identify jackpot winner 109*c* and display jackpot messages 109*d*.

Establish Jackpot Number Process 109*a*

This process randomly generates a jackpot number for the defined jackpot. The random number is generated every 24-hour period and has an effective date and time. Prior to the effective date and time, the generated number is made available for identification of jackpot winners.

Determine Player Eligibility Process l09*b*

This process monitors game sessions and determines player eligibility for one or more jackpots. A player is determined to be eligible if game play is active and the bet amount being played is equal to or greater than the amount defined when the jackpot was established. When a player becomes eligible for a jackpot, the player receives a randomly generated number applicable for that jackpot; a different random number is provided for each jackpot for which the player is eligible. If a player becomes ineligible, the random number is cleared. The random number is assigned to a player each game hand eligible for a jackpot.

There is a separate random number assigned to a player for each jackpot for which the game hand is eligible.

Identify Jackpot Winner Process 109*c*

This process monitors jackpot numbers and matches random numbers generated for players against the corresponding jackpot number. When a player's number matches the jackpot number, the player is considered a winner of that jackpot, and a message is issued to the player. There may be multiple winners of a single jackpot within a business day. When a jackpot has been won, the central office is notified. Upon initial win of a jackpot, there is a general notice advising that the jackpot has been won; this is distributed to all locations at which the particular jackpot is played.

The first reported winner of a jackpot receives a message indicating that it is the first reported win.

The message stating that a jackpot winner exists is issued immediately when the jackpot win is identified.

The message communicating a jackpot win includes the fact that players remain eligible to participate in the jackpot win.

Display Jackpot Messages Process 109*d*

This process sets up messages related to jackpots available, jackpot amounts, and jackpot status. The messages are distributed to locations with access to the jackpot.

The jackpot amount included in the jackpot notices displays the jackpot amount increasing on an incremental basis; the incremental amount will be the day's jackpot distribution divided by a 24 hour time period.

Maintain Jackpot Process 110

Figure 10:
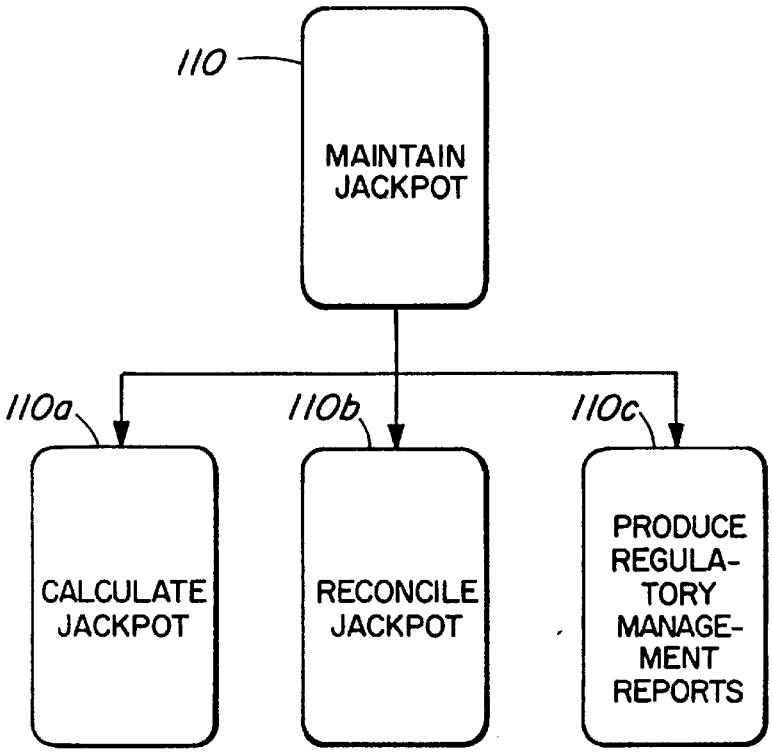
FIG. 10 is an overview of the maintain jackpot process.

With reference to FIG. 10, maintain jackpot process 110 is described which includes sub-processes calculate jackpot process 110*a*, reconcile jackpot process 110*b* and produce regulatory/management reports 110*c*.

Calculate Jackpot Process 110*a*

This process uses the revenue distributed from games revenue for the current day and increments the applicable jackpot. Each defined jackpot has its own revenue. After the jackpot balance has been calculated for the day, it is distributed to any winners of that jackpot. When the jackpot is awarded, the jackpot balance is reset to the pre-defined amount established for that jackpot.

The jackpot amount displayed on the screen is based on the previous days revenue. The jackpot amount to be awarded includes a percentage of the day's revenue. Therefore the amount of the Jackpot available for distribution today is greater than the amount displayed on the screen.

Reconcile Jackpot Process 110*b*

This process reconciles jackpot balances against revenues distributed to the jackpot and awards made against the jackpot. Jackpot awards are reconciled with payments issued and cashed. Jackpot awards that have not been issued are tracked as unclaimed funds; after one year, an unclaimed jackpot award is distributed back to the jackpot from which it was originally won.

Produce Regulatory/Management Reports Process 110*c*

This process uses jackpot records to provide regulatory reports and records regarding jackpot revenue and/or payments. Any required management reports would be produced here.

Manage Software Process 111

Figure 11:
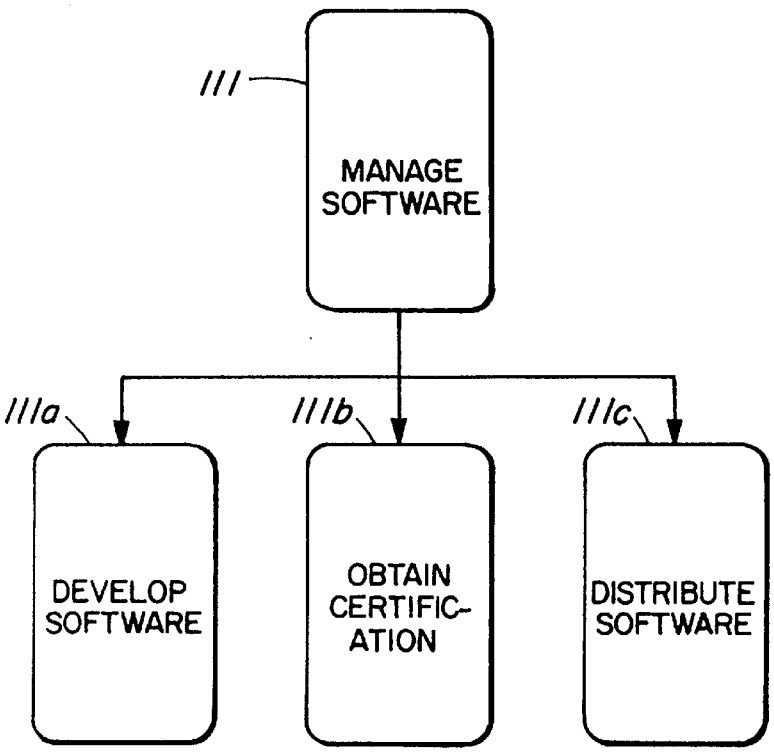
FIG. 11 is an overview of the manage software process.

With reference to FIG. 11, a manage software process 111 is described which includes sub-processes develop software process 111*a*, obtain certification 111*b* and distribute software 111*c*.

Develop Software Process 111*a*

This process customises game software to function with existing front-end equipment located within a particular hotel site. Software requirements stipulated for the jurisdictions, such as applicable pay tables, are incorporated into the software in preparation for game certification.

Obtain Certification Process 111*b*

This process migrates fully tested games from the development environment and provides the software for certification.

Distribute Software Process 111*c*

This process receives the software that has been certified and approved; the certified and approved software is distributed to the applicable gaming sites.

Manage Equipment Process 112

Figure 12:
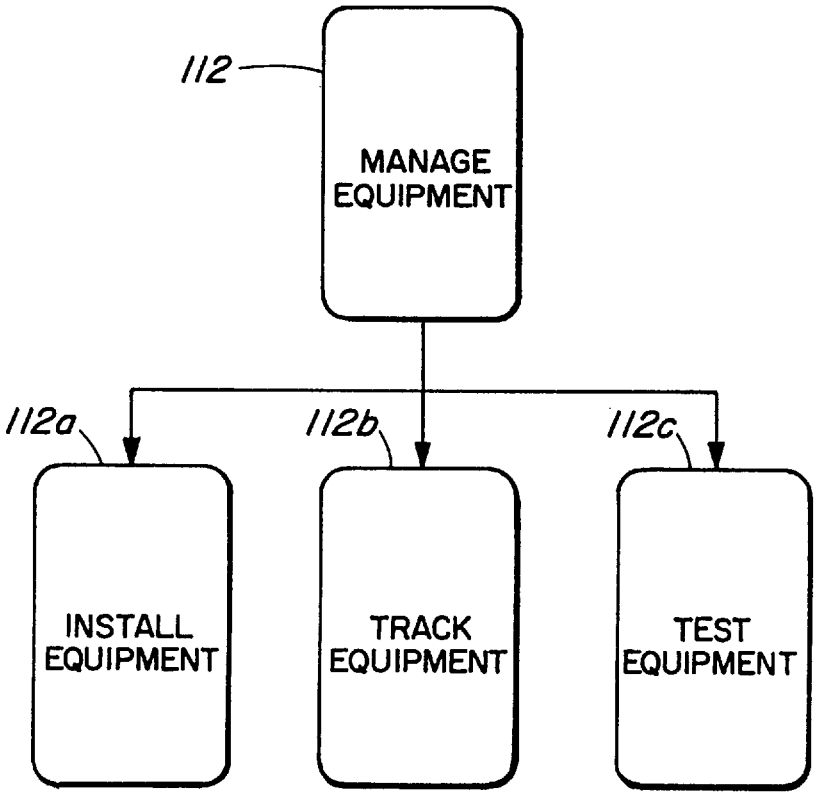
FIG. 12 is an overview of the manage equipment process.

With reference to FIG. 12, manage equipment process 112 is described which includes sub-processes install equipment 112*a*, track equipment process 112*b* and test equipment process 112*c*.

Install Equipment Process 112*a*

This process associates game devices used for game activity to both a logical and physical address. The logical address corresponds to communication channel within the computer network; the physical address defines site at which the game device has been installed.

Track Equipment Process 112*b*

This process monitors all game devices used for game play. The status's of all such devices are recorded; where exceptions are detected, appropriate equipment alerts are issued. Alerts are triggered when device tampering and/or when a device malfunction is detected. The information tracked is used for management reporting with respect to network monitoring.

Test Equipment Process 112*c*

This process disables game activity and enables physical test of a device's working order. Upon completion of a test, the game link is enabled.

EXAMPLE 1

Preliminary Transactions

Table 1 presents each key process and the transaction types flowing in and out of the process.

TABLE 1

Preliminary Transactions

| Process | Input Transactions | Output Transactions |
|---|---|---|
| 1.1 Game Access | Requests for Access Restriction | Equipment Restrictions |
| 1.2 Channel Introduction | Channel Accesses<br>Game Channel Selections | Promotional Greeting<br>Winner Interviews<br>Special Event Notices<br>Game Tutorials<br>Free Play Activity |
| 1.3 Games Play | Session Initiation Requests<br>Game Activity<br>Card Transaction Requests<br>Session Close Requests<br>Credit Card Funds Received<br>Payments<br>Audit Requests | Card Transactions<br>Game Session Activity<br>Game Activity<br>Payments<br>Payment Reconciliation<br>Game Revenue<br>Regulatory & Management Rpts |
| 2.1 Establish Jackpot | Jackpot Definition Request | Jackpot Definition |
| 2.2 Play Jackpot | Requests for Jackpot Number(s)<br>Requests for Player Jackpot Number(s)<br>Request for Eligibility | Jackpot Number(s)<br>Player Jackpot Number(s)<br>Jackpot Winner(s)<br>Jackpot Messages |
| 2.3 Maintain Jackpot | Revenue Distribution<br>Jackpot Winner(s)<br>Jackpot Payments<br>Audit Requests | Jackpot Increment<br>Jackpot Payments<br>Jackpot Reconciliation<br>Regulatory & Management Rpts |
| 3.1 Manage Software | Certification Requests | Software Certification<br>Software Distribution |
| 3.2 Manage Equipment | Equipment Requests | Equipment Distribution |

Table 2 presents typical transaction volumes are provided for those transactions considered to be significant to the application and for which there exists sufficient information on which projections can be based.

The transaction volumes presented here are estimates based upon a 500 room hotel.

TABLE 2

Preliminary Transaction Volumes

| Transaction | Daily Volumes | Annual Volumes |
|---|---|---|
| Channel Accesses | 350 (based upon a 70% occupancy) | 127,750 (based upon a 70% occupancy) |
| Card Transactions | 400 | 146,000 |
| Game Activity | 219,000 | 8 M |

TABLE 2-continued

Preliminary Transaction Volumes

| Transaction | Daily Volumes | Annual Volumes |
|---|---|---|
| Game Sessions | 100 | 36,500 |
| Game Session Activity | 200 (2 * 100 sessions) | 73,000 |
| Game Revenue | 100 | 36,500 |
| Jackpot Winners | 0–1 | 90 |
| Payments | 20 | 7,352 |

DATA MODEL 200

The Data Model 200 is a statement of the typical data requirements of the Hotel Gaming System and identifies the data components for the application to function, either to provide and track the Hotel Gaming System or in support of the regulatory controls imposed upon it.

Figure 13A:
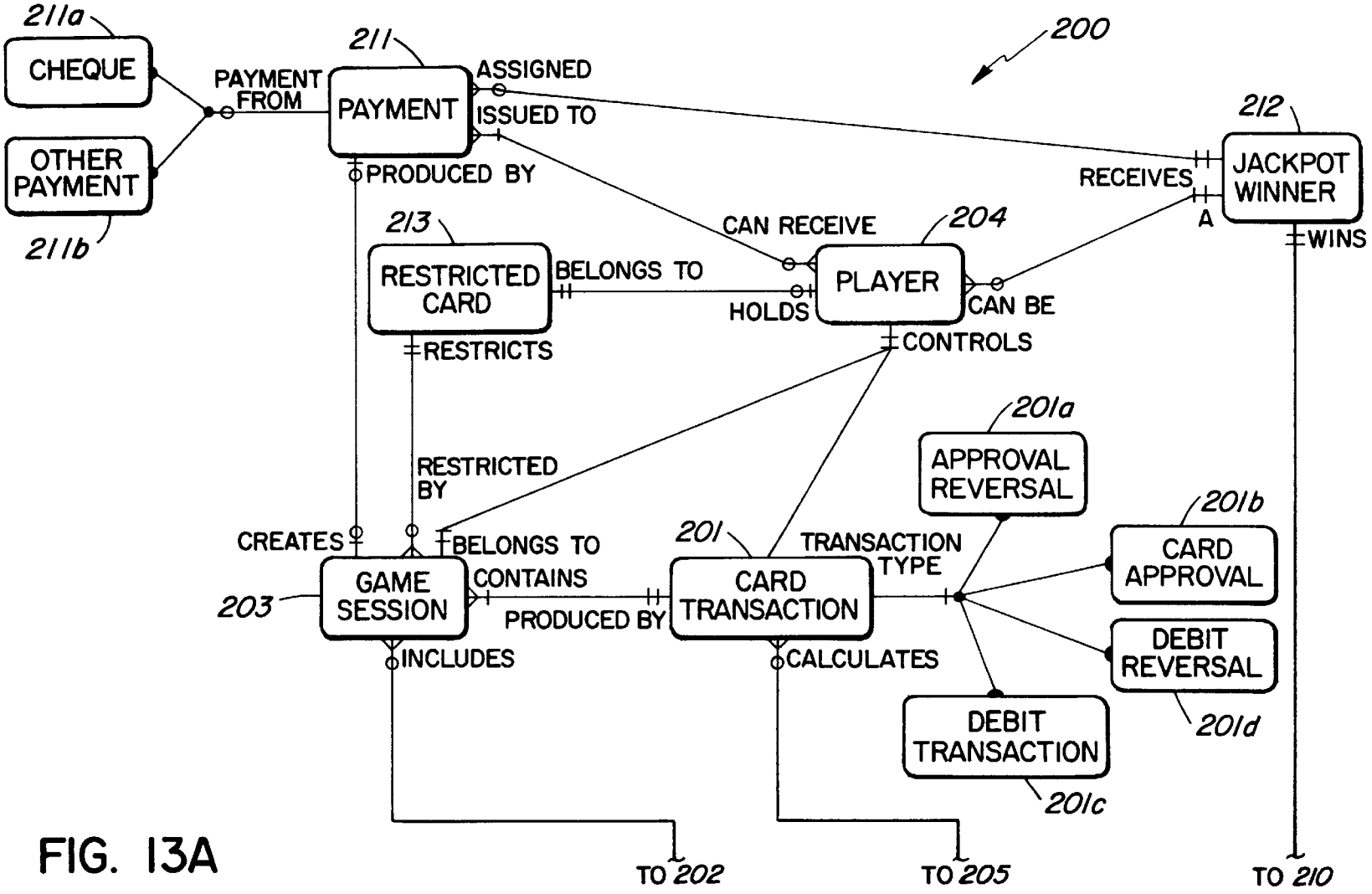
FIG. 13A is a partial overview of the data components and their relationships with other data components in the distributed gaming system.
Figure 13B:
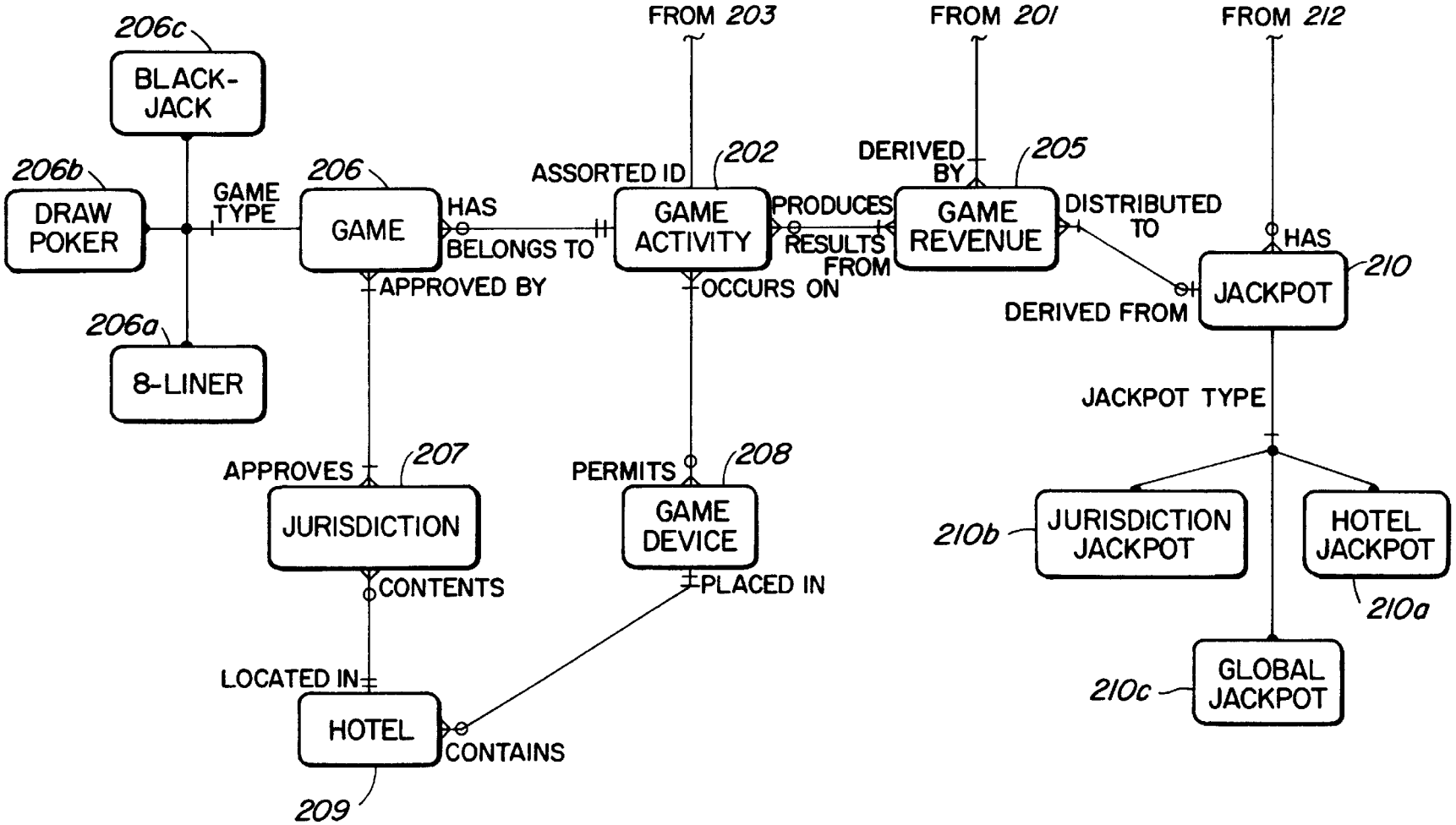
FIG. 13B is a partial overview of the data components and their relationships with other components in the distributed gaming system.

With reference to FIG. 13A and 13B, a schematic presentation of the key data components and their primary relationship with other data components is described. Its objective is to describe the scope of data required by the system and which must be supported by the system architecture. The model is not intended to define the physical design of the data.

Card Transaction 201

Card Transaction 201 is a credit card transaction detailing the time, type, and amount of the credit card event. The type of credit card transactions which can occur are:

Credit Card Approval 201*a;*

Reversal of Credit Card Approval 201*b;*

Debit Transaction 201*c*; and

Reversal of Debit Transaction 201*d*.

A credit card approval transaction 201*a* initiates game activity 202 within a game session 203; a credit card debit transaction 201*c* and/or credit card approval 201*b* and reversal transactions 201d are created when a game session 203 is closed. A player may generate additional credit card approval transactions during a game session 203.

Relationships for a Card Transaction 201:

A Card Transaction 201 belongs to Card Holder 204, is produced by a Game Session 203, is issued to a Card Approver and creates Game Revenue 205.

| Attributes: | |
|---|---|
| Card Holder Number | Primary Key |
| Date | Primary Key |
| Time | Primary Key |
| Card Holder Name | |
| Game Device Identifier | |
| Transaction Type | |
| Transaction Amount | |
| Approval Code | |
| Transaction Reference Number | |

Game 206

Game 206 is game software. A Game produces a random payout and permits a minimum and maximum bet amount. Game software may include, for example, 8-Liner 206*a*, Draw Poker 206*b*, Blackjack or Keno 206*c*.

Additional game types may be added to or may replace these games types. Each game includes a free play mode which allows game simulation; in free play mode, there is no real dollar' credit accumulation possible. The free session may be limited to 5 minutes of play.

Relationships for a Game:

A Game 206 produces Game Activity 202 and is approved by a jurisdiction 207.

Attributes:

Game Type

Game Jurisdiction

Game Software

Game Version

Game Activity 202

Game Activity 202 is a game transaction created by a Game 206; it is a record of game events and the consequential game result.

Relationships:

Game Activity takes places within a Game Session, occurs on Game Device 208, belongs to a Game 206 and produces Game Revenue 205.

Attributes:

Date

Time

Game Identifier

Game Device Identifier

Credits In (Number)

Credits In (Amount)

Credits Out (Number)

Credits Out (Amount)

Bet Amount

Event

Event Results

Game Device 208

Game Device 208 is physical hardware on which game events occur; it is identifiable to a specific physical location. Game Device 208 can be restricted from game use by hotel staff, at the request of the room patron. It is required that Game Device 208 status be monitored and that systems alerts be triggered when exceptional conditions are detected. All Game Activity 202 must be traceable to specific Game Device 208.

Relationships for Game Device 208:

Game Device is used for Game Activity 202 and is located in a Hotel 209.

Attributes:

Game Device Identifier Primary Key

Game Device Location

Game Revenue 205

Game Revenue 205 is moneys received as the result of game activity taking place within a particular time period, for example a 24-hour time period.

It is calculated from Card Transactions 201. All Game Revenue 205 is maintained in one currency, for example, US-dollars.

Relationships for Game Revenue 205:

Game Revenue results from Game Activity 202 is calculated from one or more card transactions 201, is distributed to one or more Jackpots 210.

| Attributes: | |
|---|---|
| Date | Primary Key |
| Time | Primary Key |
| Jurisdiction Identifier | Primary Key, Alternate Key |
| Hotel Identifier | Primary Key, Alternate Key |
| Game Device Identifier | |
| Game Identifier | Alternate Key |
| Credits In - (Dollars) | |
| Credits Out - (Dollars) | |

Game Session 203

Game Session 203 is a series of Card Transactions 201 and Game Activity 202 taking place on a single unit of Game Device 208 for a single player 204. Game Session 203 is retained only for the duration of the session. A Game Session 203 can be inactive, for a maximum period of twenty-four (24) or forty eight (48) hours from the time that the session started. If a Game Session 203 is inactive for 24 hours and the player is in a losing position (session credits are currently less than credit card transactions), the session is forced closed by the system. If the player is in a winning position (session credits currently exceed credit card transactions) the session can stay open for a total of 48 hours. At the close of a Game Session 203, a Payment 211 may be produced if the number of credits remaining exceeds the funds approved via the Card Transactions 201.

Relationships for a Game Session 203:

A Game Session 203 belongs to a Player 204, may produce a Payment 211, contains zero, one, or more Card Transactions 201, contains zero, one, or more Game Activities 202.

Attributes:

Card Number Primary Key

Game Device Identifier Alternate Key

| | |
|---|---|
| Date | |
| Time | |
| Session Status | Alternate Key |

Hotel 209

Hotel 209 is a location within a Jurisdiction 207, where Game Device 208 is installed.

Relationships for a Hotel 209:

A Hotel 209 exists within a Jurisdiction 207 and has Game Device 208.

| Attributes: | |
|---|---|
| Hotel Identifier | Primary Key |
| Hotel Name | |
| Hotel Address | |
| Jurisdiction Identifier | Alternate Key |

Jackpot 210

Jackpot 210 is the type, location, and amount of each jackpot available for win by one or more players. Each Jackpot is assigned a random number;

this random number is pre-assigned and recalculated within a particular time period, for example every 24-hour period. The random number generated for a jackpot and, which used for identifying jackpot winners, is secured from premature disclosure. The Jackpot 210 is incremented regularly, for example on a daily basis; only Game Revenue 205 acquired within the Jackpot 210 location (that is, within the Hotel 209 or Jurisdiction 207) is used in the calculation of the Jackpot 210 amount for that location.

In one embodiment, there are three (3) types of Jackpot 210 including Hotel 210*a*, Jurisdiction 210*b* and Global 210*c*.

Relationships for Jackpot 210:

Jackpot 210 has zero, one, or more Jackpot Winners 212, is derived from Game Revenue 205, and is associated with Game Activity 202.

Attributes for Jackpot 210:

Jackpot Type Primary Key

Jurisdiction Identifier Primary Key

| | |
|---|---|
| Hotel Identifier | Primary Key |
| Daily Opening Balance | |
| Current Daily Increase | |
| Status | |

Jackpot Winner 212

Jackpot Winner is a Player 204 who is awarded all or part of a Jackpot 210 amount. A Payment 211 is created for each Jackpot Winner 212, after the Jackpot 210 amount is calculated at the end of the business day and the total number of winners participating in the Jackpot 210 has been determined. To be a Jackpot Winner 212, the Player must have an active Game Session 203 and a minimum bet amount.

Relationships for a Jackpot winner 212:

Jackpot Winner 212 wins all or some of a Jackpot 210, receives Payment 211, and is a Player 204.

| Attributes: | |
|---|---|
| Jackpot Type | Primary Key |
| Card Holder Number | Primary Key |
| Jurisdiction Identifier | Primary Key |
| Hotel Identifier | Primary Key |
| Date | Primary Key |
| Time | |
| Card Holder Name | |
| Amount Won | |

Jurisdiction 207

Jurisdiction 207 is the regulatory agency responsible for gaming activity within a province, state or country. Jurisdiction stipulates the regulatory parameters under which game activity must occur and approves a Game 206 for use within its Jurisdiction 207. Jurisdiction may require access to all Game Activity 202 which occurred within its area of authority.

Relationships for Jurisdiction 207:

A Jurisdiction contains one, or more Hotels 209, approves a Game 206, and accesses Game Activity 202.

| Attributes: | |
|---|---|
| Jurisdiction Identifier | Primary Key |
| Jurisdiction Name | |
| Jurisdiction Address | |
| Random Payout (%) - Lower Limit | |
| Random Payout (%) - Upper Limit | |
| Bet Amount - Minimum | |
| Bet Amount - Maximum | |
| Base Currency | |

Payment 211

Payment 211 is a record of an amount issued or to be issued to a Player 204 or a Jackpot Winner 212. A Payment 211 is generated from a Game Session 203 or when a Jackpot 210 is awarded. Payments may be issued in the form of cheque 211*a* or, in the future, a credit card payment 211*b*. A Payment 211 may be issued at the local or remote site, depending upon the Payment amount. A Payment 211 that has not been received may be considered to be unclaimed funds. A Jackpot Payment includes a secured Authorization Reference Number which is used to validate ownership; the Jackpot Winner 212 must provide the Authorization Reference Number in order to obtain Payment.

Relationships for Payment 211:

A Payment is issued to a Player 204 or a Jackpot Winner 212 and is produced by a Game Session 203 or by a Jackpot Award.

| Attributes: | |
|---|---|
| Payment Reference Number | Primary Key |
| Payment Date | Primary Key |
| Payment Time | |
| Payment Amount | |
| Card Holder Number | Alternate Key |
| Card Holder Name | Alternate Key |
| Jackpot Type | Alternate Key |
| Jurisdiction Identifier | Alternate Key |
| Hotel Identifier | Alternate Key |
| Authorization Reference | |
| Payment Type | |
| Payment Status | |
| Issue Date | |
| Issue Time | |

Player 204

Player 204 is a card holder who initiates a Game Session 203 and executes Game Activity 202. Player 204 can create all Card Transactions 201, except a Debit Transaction Reversal 201*d*. A Player 204 may be restricted from initiating a Game Session 203 based upon the card holder number. Player information is maintained at the transactional level to support Card Transactions and Payments.

Relationships for Player 204:

A Player 204 controls Game Session 203, may hold a Restricted Card 213, can receive Payment 211 and can be Jackpot Winner 212.

Restricted Card 213

Restricted Card 213 is a credit card number that cannot be used to initiate a Game Session 203 or be used within a Game Session 203 to obtain funds for Game use. Restricted Card information is entered and maintained by the network operations centre 22.

Relationships for a Restricted Card 213:

A Restricted Card 213 belongs to a Player 204, prevents access to a Game Session 203, is added to a restricted card file by the network operations centre 22.

| Attributes: | |
|---|---|
| Card Holder Number | Primary Key |
| Card Holder Name | Alternate Key |
| Date | |
| Time | |
| Status | Alternate Key |

Summary

Table 3 summarises the preliminary data characteristics, organised by entity. The Data Volumes presented are for a single Hotel, and based upon the following premises:

The Hotel has 500 rooms.

Twenty percent (20%) of the rooms will have a Game Session.

Each Game Session will have an estimated two (2) hours of active game play.

Game Activity within a Game Session will be sixty-five percent (65%) Draw Poker and/or Blackjack; the remaining thirty-five percent (35%) will be 8-Liner.

Draw Poker and Blackjack can have ten (10) games played per minute.

8-Liner can have fifteen (15) games per minute.

A Game Session will have two (2) credit card swipes.

The average player will spend forty-five (45) dollars per day/Game Session.

Twenty percent (20%) of players will receive a payment.

Restricted Card will be one percent (1%) of total players.

TABLE 3

| | Data Characteristics | | | | | |
|---|---|---|---|---|---|---|
| Entity | Data Volumes Daily | Data Volumes Annual | Data Retention | Data Currency | Data Accessibility, Usage, and Security | Audit Requir-ments |
| Card Trans-action | 400 | 146,000 | Year | Transactional | Revenue Receipt and Calculation Inquiries | As stipulated by Card Approver |
| Game Device | 500 | 500 | Permanent | Periodic | Game Access and Monitoring Inquiries | None Defined |
| Game | 3 | 3 | Regulatory | Periodic | Game Play and Game Management. Must be secured from manipulation. | Certified for Jurisdiction |
| Game Activity | 219,000 | 8M | Regulatory | Transactional | Game Tracking Must be secured from manipulation. | As stipulated by Regulatory Agency |
| Game Revenue | 100 | 36,500 | Year | Daily | Revenue Calculation and Distribution | As stipulated by Regulatory Agency |
| Hotel | 1 | 1 | Permanent | Periodic | Validation and Informational | None Defined |
| Jackpot | 3 | 3 | Year | Daily | Jackpot Play | As stipulated by Regulatory Agency |
| Jurisdiction | 1 | 1 | Permanent | Periodic | Validation and Informational | None Defined |
| Payment | 20 | 7,352 | Year | Transactional | Game Payment | Reconcilable to Game Activity and Jackpot |

TABLE 3-continued

| Entity | | Data Volumes Daily Annual | Data Retention | Data Currency | Data Accessibility, Usage, and Security | Audit Requirements |
|---|---|---|---|---|---|---|
| | | Data Characteristics | | | | |
| Player | 100 | 36,500 | Not Applicable | Not Applicable | Not Applicable | Not Applicable |
| Game Session | 100 | 36,500 | Duration | Current | Game Play Player Support | None Defined |
| Jackpot Winner | 0–1 | 90 | Year | Transactional | Jackpot Play and Jackpot Maintenance | Reconcilable to Jackpot |
| Restricted Card | 1 | 365 | Permanent | Periodic | Game Access | Not Defined |

SOFTWARE

APPLICATION ARCHITECTURE

Overview

The application architecture for the Hotel Gaming System is based on a series of co-operating applications that exchange data via file transmissions and messaging operations.

The major components of the application software are as follows:

1. Network Operations Application Software
2. Hotel Back Office Software
3. Gaming Software
4. Channel Broadcast Facility
5. Set Top Box Software The Network operations application software provides the administrative functions for the system. The Back Office software controls the game sessions and manages the execution of the game software. The gaming software operates in a multi-user mode and provide the game play to guests on the hotel room TV 14. The set-top box 12 located in the Hotel Room 13 displays video, text and sounds on the TV set and delivers remote control signals to the gaming software.

Network operations Application Software

The Network operations application will run on a server 36 and communicate with Hotel Back Office Servers 18 through data file transfers and remote file queries. The model depicts a single Network operations Server. As the system is expanded into a second jurisdiction, a new central office server is required and some functionality will transfer to the central office level (e.g. Global Jackpot Management). However, the majority of the application functionality will reside at the jurisdiction level. The functions of the software include:

Software Function

- Receives and processes the daily transaction log files from the Hotel Back-Office servers;
- manages the revenue;
- calculates and distributes the daily jackpot amounts;
- generates and distributes predetermined jackpot numbers;
- receives and processes Jackpot winner messages from Hotel Servers;
- prints jackpot cheques;
- extracts a file of recent winners and distributes to Hotel Servers for display on the Gaming Channel;
- provides a facility for network operations staff to enter promotional text material and distribute to Hotel Back Office Servers for display on the Gaming Channel;
- provides a facility for Administration to maintain a file of restricted card numbers and distributes this file to all Hotel Back Office locations;
- provides Gaming and Jackpot cheque issue files to Bank for Cheque Reconciliation;
- prints Management Information Reports;
- prints Regulator Reports;
- provides on-line access to data files for Gaming Regulators;
- creates and produces taxation reports;
- provides data archival services for the system;
- creates and transmits credit card transaction files and
- provides player support with on-line access to credit card transaction information.

The main users of the Network operations software are network operations administration staff and Player Services staff using personal computer (PC) workstations. Printers are used for report generation and tape storage devices are used for system archives. Preferably, on-line queries and ad hoc reports can be obtained from the system.

Interfaces:

The following interfaces are provided by the Network operations Application Software

- File and message transmissions between the Network operations Server and each of the Hotel Servers;
- file transmissions of credit card Transactions to the credit card acquirers;
- file transmissions of cheques issued files to Bank performing cheque reconciliation function; and,
- Regulator on-line access to jurisdiction data files.

Security

Preferably, a high degree of security is implemented for access to data files. Special encryption functionality may be used for picking the Jackpot number and distribution to Hotel Servers.

Integrity and Availability

The system implements a high degree of data integrity and system availability is required. In that, the operation of the game function is decentralized on the Hotel Office Server, interactive access to Network operations data is not required for the games to function. However, it is preferable that daily transmissions of data between the Network operations Server and the Hotel Servers be implemented.

Back Office Application Software

The Hotel Back Office application will run on a server 18 and communicate with Network operations Server 36 through data file transfers and remote file queries. The functions of the software include:

- Receives and stores predetermined daily Jackpot numbers;
- receives recent winner text file from Network operations Server and displays text on the Gaming Channel;
- receives promotional material text file and displays on the Gaming Channel,
- initiates gaming session;
- receives a file containing restricted card numbers from the Network operations server and prevents a card from activating a session if the number is on the file;
- provides player support with on-line update access to gaming device control file to facilitate the deactivation of a gaming device for a predetermined time period to satisfy a request from a Hotel guest;
- reads the magnetic stripe information on the credit card as supplied by the credit card swipe device located in the hotel room;
- obtains credit card approval;
- manages the game play through execution of Game Software;
- assigns a jackpot number for qualifying hands/spins;
- determines if there is a jackpot winner and notifies the winner and the Network operations server;
- prints cheques and receipts;
- transmits the daily transaction log files to Network operations; and
- provides player support with on-line read access to current gaming session information.

Player Services 30 has the ability to remotely inquire on the game session file in order to assist the player with questions related to the current game. Player support can also have remote update access to a gaming device control file which will deactivate a gaming device for a specified period at the request of a Hotel Guest. Cheque and receipt printers will be accessible to the Hotel Staff.

Interfaces

The following interfaces are provided by the Hotel Back Office Application Software

- File transmissions between the Hotel Back Office Server 18 and the Network operations Server 36;
- on-line link to credit card acquirers for real-time approval of credit card transactions;
- program level links between session management and the gaming software and
- massaging interface between the Hotel Back-Office Server 18 and the set-top boxes 12 and credit card swipe devices 16 in the hotel rooms.

Security

Preferably, a high degree of security will be available for access to data files. Special encryption functionality for receiving/storing the Jackpot numbers and for picking the player qualifying jackpot numbers and matching to the predetermined jackpot numbers is preferably implemented.

Integrity and Availability

The system implements a high degree of data integrity and a very high level of system availability. The operation of the game function is decentralized on the Hotel Office Server 18. A fault tolerant architecture is also, preferably, implemented along with daily transmissions of files to the Network operations Server.

Game Software

Software Function

- Operate in a multi-user mode within the Hotel Back-Office Server;
- provide Game functionality for a number of games such as Draw Poker, 8 Liner Slots and Blackjack (or Keno);
- integrate with the session management software which will increase credits through credit card transactions and handle payout function; and
- communicate with the TV set-top box for the display of graphics, text and sounds and receipt of remote control signals.

The hotel room guest accesses the game function through the TV set-top box.

Interfaces

The Game Software has the following interfaces:

- Program level links between the Game Software and the session management software;
- data transmission to the TV set-top boxes; and,
- receipt of remote control signals from the set-top boxes.

Security

Jurisdiction regulations will likely require a high degree of security for the storage and access of the gaming software on the Hotel Back-Office Server. Accordingly, the system contemplates security in the form of program storage on a Compact Disk (CD) or program storage on an EPROM chip resident on a board accessible to the server.

Integrity and Availability

The system provides a high degree of data integrity and system availability through duplicate storage devices to provide fault tolerance.

Channel Broadcast Facility

An optional feature of the system is a channel broadcast facility.

Software Function

- Obtains video images from a video tape machine, multimedia Compact Disk or Optical Compact Disk;
- Distributes a video signal for the Gaming Channel greeting and tutorial on a cable TV channel. This signal will be displayed through the set-top box.

The channel broadcast equipment may consist of a video player (or optical disk player) and RF modulator hardware to broadcast on a channel and a PC to manage the video broadcast.

Interfaces

- Interface to video play device and
- access to cable signal.

Security

Security for this equipment will be considered medium. Accordingly, this equipment would be located in a secure area in the Hotel Back Office where access can be gained to the TV Cable.

Integrity and Availability

The video files will be recorded by an external agency and may be available for broadcast on the Gaming Channel 24 hours per day. The video material would be changed on a regular bases (e.g. every 2–3 months). In order to ensure a level of fault tolerance, multiple video players may be implemented.

Set-Top Box Software

Software Function

- Receives data messages from the Back Office Gaming Software and a channel video feed from the Channel Broadcast Facility;
- Presents video, graphics, text and sounds on the room TV; and Provides signals from the remote control to the Back Office Gaming Software.

The Hotel Guest will interface with the Hotel Gaming System through the use of remote control unit 20. The TV set-top box 12 receives the signals from the remote 20 and passes the signals to the gaming software on the Hotel BackOffice Server 18.

Interfaces

Connect with the Hotel Back Office Server to receive data messages and send remote control signal data;

connect with a cable-in feed from the standard Cable line (may be from a movie channel set-top box);

provide a cable-out line to connect to the TV set for display of game graphics, text and sound.

Security

The set-top box is preferably sealed in order to resist tampering. The software within the set-top box 12 is limited to the operating system and graphic/sound files and does not contain any gaming program logic. The box 12 may support a download of set-top box programs e.g. new graphics.

Integrity and Availability

The set-top box 12 provides a high degree of integrity and availability. The set-top box 12 performs diagnostic checks and sends alert messages to the Network Monitoring software, if problems are encountered.

DATA STORAGE STRATEGY

Overview—Data Storage Strategy

The strategy for storage of data in the Hotel Gaming System is described below. Reference is made to the three major components of the Hotel Gaming System: set top box 12, hotel back office server 18, and network operations server 36.

Summary—Data Storage Strategy

The set top box 12 stores programs for the operating system, communication and equipment management, and graphic generation and display logic.

The hotel back office 18 server contains the gaming software and its transaction data. It also stores the communication and equipment management software.

The network operations server 36 stores the network operations management applications and data.

Details—Data Storage Strategy

Set Top Box 12

The set top box 12 is an intelligent device that receives signals from the hotel back office server 18 and translates the signals to video streams for the television 14. The set top box 12 contains its operating system, communication and equipment management, and graphic generate and display logic. Table 5 describes the types of information stored in the set top box along with the data format, estimated size, and storage media type.

TABLE 5

Set top Box Information

| Information | Data Format | Estimated Size | Storage Media Type |
|---|---|---|---|
| Operating system | System specific native formats | 256 KB | Erasable and Programmable Read Only Memory (EPROM) and Read Only Memory (ROM) |

TABLE 5-continued

Set top Box Information

| Information | Data Format | Estimated Size | Storage Media Type |
|---|---|---|---|
| Communication and equipment management | Application specific native formats | 256 KB | EPROM and ROM |
| Graphic generate and display logic | Application specific native formats | 1 MB | EPROM and ROM |

Hotel Back Office Server 18

The hotel back office server 18 contains the gaming software and its transaction data. It executes the gaming software and distributes digital signals to the set top boxes. In return, it receives and stores all the gaming transactions from its set top boxes. The gaming software is stored in application specific native formats for random access whereas the gaming transactions are stored in generic formats.

TABLE 6

Hotel Back Office Server Information

| Information | Data Format | Estimated Size | Storage Media Type |
|---|---|---|---|
| Operating system | System specific native formats | 16 MB | Random Access Memory |
| Operating system | System specific native formats | 300 MB | Disk |
| Communication and equipment management | Application specific native formats | 2 MB | RAM |
| Communication and equipment management | Application specific native formats | 20 MB | Disk |
| Gaming application software - black jack | Application specific native formats | 2 MB | RAM |
| Gaming application software - black jack | Application specific native formats | 10 MB | Disk |
| Gaming application software - poker | Application specific native formats | 2 MB | RAM |
| Gaming application software - poker | Application specific native formats | 10 MB | Disk |
| Gaming application software - 8-liner | Application specific native formats | 2 MB | RAM |
| Gaming application software - 8-liner | Application specific native formats | 10 MB | Disk |
| Gaming transactions per week | Texts and numbers | 36 MB | Magnetic disk (hard disk) and Read Only Memory (ROM) |
| Archived gaming transactions per week | Texts and numbers | 22 MB | Magnetic tape and CD |

Total estimate disk storage requirement is 408 MB (.5GB)

Example

Assumptions and Calculations

Game Play Statistics for 1 player:

Draw Poker and Blackjack (Note: Blackjack may be replaced by Keno)

3 seconds per deal assume that there are 2 deals per hand

Approx. 20 deals per minute (10 hands/games per minute)

8-liner

If allowed to continue for the normal cycle, the spin will take about 7 seconds

If the player stops the spin, the length of time would be between 1 second and 7 seconds. Assume that average is 4 seconds per spin.

Approximately 15 spins per minute

For poker & blackjack the rate would be 1,200 deals per hour (20×60 min) or 600 hands (games) per hour.

For 8-liner the rate would be 900 spins per hour (15×60 min).

Total Records per day

Assume a 500 room hotel with 20 percent of the people playing the game that day. Assume 100 sessions per day. Assume the 100 people each played for 2 hours that day and assume a 65% 35% split between cards and 8 liner.

Number of sessions per day 100

Number of credit card approvals per day 200

The average session that consisted of 65% card games and 35% 8-liner would result in:

cards—1,200 deals per hour x 2 hours (65% split)=1,560 deals per session 8-liner—900 spins per hour x 2 hours (35% split)=630 spins per session This is a total of 2,190 spin/deals per session (1,095 per hour)

Assume 1 record for each spin/deal:

The average session would consist of 2,190 (spin/deals) per session or a total of 219,000 records per day.

Assume 24 bytes for each record:

The size of transactions per day is 219,000*24=5,256,000 bytes or 5,133 Kbytes or 5 Mbytes.

Assume one week (7 days) of transactions to be kept on line:

The size of transactions per week is 5,256,000*7=36,792,000 bytes or 35,930 Kbytes or 36 Mbytes.

Assume compress rate is 60%:

Size of achieved transactions per week is 36,792,000*60%=22,075,200 bytes or 21,558 Kbytes or 22 Mbytes Network operations Server 36

The network operations server 36 stores and executes the network operations management applications. In a predefined period of time, the network operations server receives gaming transactions from the hotel back office servers 18. The network operations server 36 then processes the transactions and distributes reports and files. Table 7 describes the types of information stored in the network operations server along with the data format, estimated size, and storage media type:

TABLE 7

Network Operations Server Information

| Information | Data Format | Estimated Size | Storage Media Type |
|---|---|---|---|
| Operating system | System specific native formats | 16 MB | RAM |
| Operating system | System specific native formats | 300 MB | Disk |
| Communication and equipment management | Application specific native formats | 5 MB | RAM |
| Communication and equipment management | Application specific native formats | 100 MB | Disk |
| Network operations management application software | Application specific native formats | 20 MB | RAM |
| Network operations management application software | Application specific native formats | 200 MB | Disk |
| Gaming transactions from all hotel back office per week | Texts and numbers | 3,600 MB | RAM and disk |
| Archived gaming transactions | Texts and numbers | 2,200 MB | Magnetic tape and CD |
| Financial and administration transactions | Texts and numbers | 900 MB | RAM and disk |
| Archived financial and administration transactions | Texts and numbers | 540 MB | Magnetic tape and CD |

Total estimate disk storage requirements is 8,000 MB (8GB)

Example

Assumptions and Calculations

Assume 100 hotel installations:

The size of gaming transactions of all installations per week is 36*100=3,600 Mbytes or 3.5 GB The size of achieved gaming transactions of all installations per week is 22*100=2,200 Mbytes or 2.2 GB Assume average gaming and management transactions ratio is 25%:

The size of management transactions is 3600*25%=900 Mbytes

Assume compress rate is 60%:

Size of achieved management transactions per week is 900 Mbytes * 60%=540 Mbytes

SECURITY STRATEGY

Overview—Security Strategy

This section provides a high level description of the security strategy for the Hotel Gaming System. The security strategy defines how the components are integrated to ensure security of the system.

1. Summary—Security Strategy

Generally, the security strategy has three major concerns:

a) confidentiality;

b) integrity;

c) availability.

Confidentiality is the most well known security concern. It relates to the privacy of the system and the information in it. Confidentiality is about making sure that only authorized users have access to the system or its information. This includes information travelling across a network. It also involves ensuring that unauthorized users do not have access to the system. There are of course degrees of authorization. Some users may need to access some system files but not others.

Integrity refers to how accurate the information on the system is. It means that you can rely on the quality of the information; no one has tampered with or altered it without proper authority. Integrity is more important in some applications than others. Financial systems in particular must be accurate and must reliably prevent unauthorized users from changing information.

Availability refers to the system and the information on it being available whenever an authorized user wants it. If an attacker has somehow brought the system down or has hidden an essential file, a security problem exists. Disaster recovery planning is a major part of ensuring availability.

A.Details—Security Strategy

This section describes a high level security strategy for the Hotel Gaming System. The two aspects of system security covered in this section are:

a) Jurisdiction Requirements for Gaming Devices and b) General Security Requirements for the Architecture.

Jurisdiction Requirements for Gaming Devices

The Hotel Gaming System offers the type of computer gaming that it currently available on some Video Lottery Terminals (VLTs). Jurisdiction regulations currently describe standards for VLTs. The Hotel Gaming System is very different than a VLT and jurisdiction regulations do not specifically refer to this type of computer architecture for gaming devices.

For VLTs, the computer gaming programs are resident in the VLT. The gaming device is self contained. The onboard program plays the game and later sends game results to a central game device management system. There are a lot of security implications for player accessible VLTs and hardware security techniques such as storing the programs on sealed EPROM chips are employed. The EPROMs are registered and installed in machines under the supervision of the jurisdiction authority.

With the Hotel Gaming System architecture, the computer gaming programs execute in a Hotel Back Office server. The role of the TV set-top box is limited to displaying the computer images on the TV screen. Game program logic resides in the player accessible set-top box. Communications between the Hotel Back Office Server and the set-top box is encrypted. The Hotel Back Office Server is kept in a secure area of the hotel and is not accessible to the public.

General Security Requirements for the Architecture

The first major security mechanism is Identification and Authentication (I&A). This is for accurately identifying anyone who tries to access the system in any way. The classic I&A mechanism is user names and passwords. The name identifies the user and the password authenticates the user. There are now I&A products that use tokens such as access cards or keys. This provides even more security than password schemes. In general terms the following I&A mechanisms are used. At the set top level, access is restricted to communication via the Back Office Server. For example, the Back Office and Network operations Servers have standard UNIX I&A security. The network devices have the full implementation of available security. Connections to external entities follow the requirements of the external entities and connections from external entities and have access to schemes selected for the network operations.

Because of the financial aspects of the Hotel Gaming System, the system may also implement audit recording of significant events. An audit trail is for reconstructing an event after it occurs. Knowing that an audit system is there also deters potential misuses of the system by untrustworthy employees. An employee is less likely to try to break into the employer's system if they know that the system is recording actions. Auditing is a CPU- and storage-intensive operation and normally selects specific types of actions for audit in order to reduce the size of the audit trail. For the Hotel Gaming System, the system may log all transactions locally and perform a back-up to the local network operations or jurisdictional server on a daily basis.

The Hotel Gaming System has sensitive information moving from place to place, and may, therefore, use encryption in the network. There are two basic approaches to cryptography: public key and secret key. Generally secret key cryptography is better in a highly controlled environment with a trustworthy way of distributing the keys. Public key cryptography is likely to work better in an environment that does not have the same level of control or that has a very large number of hosts. There are two main communication links within the hotel gaming system. The first link is between the servers. This link requires a secret key due to the possible openness of the network involved. The other link is the link between the back office server and the set top boxes. This link can function on a public key as physical access to the network is restricted.

The Hotel Gaming System may support separation of duties. This means that any user of the system only has access to those data and functions that he or she needs for his or her job in order to strictly limit the number of people who have access to the most sensitive data or functions. This is implemented by properly structuring system functions and operator permissions.

To ensure adequate availability, the system contemplates redundancy or fault tolerance in some parts of the system with remote network monitoring and management. Accordingly, the system contemplates servers having a fault tolerant configuration with full remote monitoring and system management implemented.

Finally, the system contemplates adequate physical and procedural security measures. For example, the server machines at each site should not be in a room open to the public. The elements of the system that are in public areas should include tamper-resistant features to prevent players from meddling with them as well as procedures and policies to govern how employees and others work with the system. Physical security is implemented at each level of the system. For example, it is preferred that the network operations server be placed in a secure data centre environment, the Back Office server in a tamper resistant racking system, and the set top box having only limited functionality to reduce the reason for tampering.

Infrastructure Interface Strategy

Overview—Infrastructure Interface Strategy

This section identifies the preferred technical approach for establishing interfaces between the major components of the Hotel Gaming System.

The Hotel Gaming System has the following subsystem interfaces:

1. Between network operations and hotel back offices
2. Between network operations and credit card acquirers
3. Between network operations and banks
4. Between network operations and jurisdiction agencies
5. Between hotel back office and set top boxes 6. Between hotel back office and credit card acquirers
7. Between set top box and credit card swipe
8. Between set top box and its remote control
9. Between channel broadcast facility and set top boxes A. Details—Infrastructure Interface Strategy Subsystem interfaces are those interfaces between subsystems, between internal applications, and between the internal applications and applications external to the hotel gaming system. These interfaces may be implemented on one platform or may cross technology boundaries.

1. Between network operations and hotel back offices

The system contemplates the use of File Transfer Protocol (FTP) to transfer files between the network operations and the hotel back office. FTP is a TCP/IP communications protocol that is used by the system administrator to log onto to a hotel back office server to copy files and perform other administration tasks.

2. Between network operations and credit card acquirers

The interfaces between the network operations and the credit card acquirers are defined by the standards set by the credit card acquirers.

3. Between network operations and banks

The interfaces between the network operations and the banks are defined by the standards set by the banks.

4. Between network operations and jurisdiction agencies

The system contemplates the use of Structured Query Language (SQL) as the interface between the network operations and the jurisdiction agencies. SQL is the industry standard language used for referencing and accessing a relational database. This can isolate the hardware, system software, database products, etc. from the jurisdictional agency and allows the agency to select, query, or browse its own jurisdictional data.

5. Between hotel back office and set top boxes

The system contemplates the use of Transmission Control Protocol/Internet Protocol (TCP/IP) as the interface between the hotel back office server and its set top boxes. TCP/IP is a communications protocol to link dissimilar computers (server and set top boxes) across the network.

6. Between hotel back office and credit card acquirers

The interfaces between the back office and the credit card acquirers are defined by the standards set by the credit card acquirers.

6. Between set top box and credit card swipe

The credit card swipe is linked to the set top box using a standard peripheral interface (e.g. RS-232). Since the credit card swipe is an industry standard device, the communication protocol is dictated by the card device.

7. Between set top box and its remote control

The communications between the set top box and the remote control is through infrared signals. The remote control generates infrared signals and transmits to the set top box. The set top box will interpret the signals and pass the information to the back office server.

8. Between channel broadcast facility and set top boxes

The channel broadcast facility is a device similar to a home VCR. It is used to broadcast video signals (introduction channel) and insert them onto the regular cable services. The channel broadcast facility contemplates the use of existing coaxial cable to deliver video signals to the set top boxes.

Recommended Technology Products

Overview—Recommended Technology Products

The architecture identified for the Hotel Gaming System is described below in accordance with the following assumptions:

1. There are 500 set top boxes connected to a back office server. This configuration is scalable up to 1000 set-top boxes at one location.
2. Up to 100 Hotel Back Office servers connected to a network operations server.
3. The configuration refers to a single Network operations Server. As subsequent jurisdictions are established, it is likely that one network operations server per jurisdiction and an additional server to support central functions such as the global jackpot and production of management information reports be utilized. The recommended profile can support this redistribution of function.

Details—Recommended Technology Products

Description

In the discussion of recommended technology profile, reference is made to the three major functional areas: hotel room, hotel back office, and network operations and FIG. 1.

The Hotel room configuration consists of a set top box 12 and a credit card swipe unit 16. The set top box 12 is an intelligent device that receives data from the back office server 18 and translates it into video streams for the television 14. It is contemplated that graphic logic may be used in the set top box 12 to significantly reduce communication bandwidth between the set top box 12 and back office server 18 and permit the use of unshielded twisted pair cabling (telephone line wire).

The hotel back office 19 has a server 18, two printers 19a, and associated software. The specific selection of the server is tightly linked to that of the set top box 12. If the set top box 12 is provided with built-in graphic logic, the back office server 18 can be an industry standard UNIX platform capable of supporting a variable number of set top boxes 12 and capable of detecting faults such as communications and equipment faults.

The network operations equipment configuration has a database server 36, workstations 38, printers 36*a* and associated software. The network operations server 36 may be an industry standard UNIX platform capable of supporting the communications and reporting requirements of the system. The platform may also serve as the basis for financial and management applications. The workstations and the printers 36*a* are used to support administrative tasks.

Hotel Room 13

Credit Card Swipe Technology Profile

The function of the credit card swipe device 16 is to obtain the player name and card number from the credit card magnetic stripe and pass the data back to the back office 19 via the set top box 12. The credit card swipe 16 device can be any industry standard product that can read data from a credit card as input and output data to the set top box 12.

Set Top Box Technology Profile 12

The set top 12 is the main unit which communicates with the hotel back office server 18. The set top box platform recommended for the Hotel Gaming System should have the following characteristics:

tamper resistant
support variable sizes of applications (up to 2 MB)
support graphics screen generation
support credit card swipe
support required communication protocol
support analog cable in/out (NTSC/PAL)
support digital in/out
support remote control unit interface
support self test and remote management The set top box 12 should be tamper resistant, that is, sealed and the chip sets not carrying any identifiable labels. The operating system of the set top box 12 should be able to identify tampering attempts and decrypt incoming data and encrypt outgoing data through software.

The set top box 12 should be able to support the display logic of different sizes of gaming applications such as poker, 8-liner, and black jack or keno.

The set top box 12 also translates digital data received from the back office server 18 into a video stream for the television and recognizes signals from the remote control unit 20 and transmits data back to the back office server 18.

The set top box 12 should also be capable of supporting different peripherals such as a credit card reader 16 which interfaces with the set top box 12. Once the set top box 12 receives data from the credit card reader 16, it must be able to pass that data to the back office server 18 for verification.

The set top box 12 must support the required communication protocol.

It is recommended that the set top box 12 support analog cable in/out (PAL/NTSC), and digital in/out and be able to decode analog and digital signals and switch from analog feed to digital feed and back as well as being able to display message text at the bottom of the television.

It is a preferred requirement for the set top box 12 to support a remote control unit interface 20 and be able to interpret the signal from the remote control unit 20 and transmit the data to the back office server 18.

It is also preferred that the set top box 12 have built in diagnostic tests that are invoked automatically at power-up or as necessary from the remote back office 19. It also should have some ability to automatically correct simple internal faults and to notify the back office 19.

Hotel Back Office 19

Hardware:

The recommended hotel back office 19 configuration consists of the following hardware components:

- One fault tolerant rack-mounted UNIX server
- 64 MB of RAM
- 2 GB hard drive
- One 3.5" 1.44 MB floppy drive
- One double speed CD-ROM
- 14" SVGA colour monitor (may be a portable unit for system maintenance use)
- Keyboard (may be a portable unit for system maintenance use)
- Tape backup unit
- Uninterrupted power supply unit (UPS)
- Two dot matrix printers
- Networking cable System Software

- UNIX operating system
- Gaming applications
- UPS monitoring software

Technology Profile:

The preferred back office server selected should have the following characteristics:

- tamper resistant
- support required gaming and administration applications
- support required peripherals
- support required communication protocol
- support variable number of set top boxes
- support analog cable in/out
- support digital in/out
- support UPS and system fault tolerance or duplexing
- remote management The preferred back office server 18 is also tamper resistant and be able to identify tampering attempts and provide for encrypted data transmits between the back office 19 and the set top boxes 12 and the back office 19 and the network operations 22. In addition, the security of the back office server 18 should be rated.

The back office server 18 must be able to support different gaming and administration applications.

The preferred back office server 18 also supports different standard peripherals such as a network printer 19*a*, a router 19*b* to the network operations server, a CD-ROM (not shown), a tape drive (not shown), and a modem 19*c* to the credit card company and support the required communication protocol.

The preferred back office server 18 is scalable to support up to 1,000 set top boxes 12 within a hotel installation. If the hotel has more than 1,000 set top boxes, there may be more than one server in that hotel.

The back office server 18 should support analog cable in and out, and UTP digital in and out and allow regular cable to go through and communicate with the set top box with digital signal if the player chooses to play game.

The back office server 18 should have an uninterrupted power supply (UPS) (not shown) to minimize the impact of a power outage. In the event of power outage, the UPS must kick in immediately to minimize data lost.

The back office server 18 should have built in diagnostic tests. These should be invoked automatically at power up or as necessary from the remote network management site 22. The back office server 18 should have some ability to automatically correct simple internal faults and to notify the network management monitoring software. An internal log of errors and significant events should be available for analysis by the office where basic re-start/corrective actions are performed from the network management site.

The recommended printers should be capable to print receipts and cheques on pre-printed forms.

Network operations Equipment

Hardware:

The network operations configuration consists of the following hardware components:

- UNIX server
- 128 MB of RAM
- 8 GB hard drive
- 3.5" 1.44 MB floppy drive
- Double speed CD-ROM
- 14" SVGA monitor
- Keyboard
- Tape backup unit
- UPS
- 486-class workstations (administration and operation)
- 14" SVGA colour monitor
- Keyboard
- Mouse or track ball
- laser printers for reports
- dot matrix printers for cheques
- Networking cable System Software

- UNIX operating system
- RDMBS with networking software
- Network operations management software
- Game administration and management software
- UPS monitoring software Technology Profile The network operations server should have the following characteristics:

tamper resistant support various financial and administration applications support required peripherals support required communication protocol support variable number of back office servers support UPS and system fault tolerance or duplexing The preferred network operations server 36 is tamper resistant and be able to identify unauthorized access or attempted access. It is preferred that the data transmitted between the network operations and the back offices be encrypted. The network operations server 36 should also be able to define access restrictions and network administration. In addition, the security of the network operations server should be rated.

The network operations server 36 supports different financial and administration applications and should be flexible enough to produce ad hoc reports or statements to fulfil different jurisdiction requirements.

The network operations server 36 should be capable of supporting different standard peripherals such as a network printer 36*a*, a modem 36*b* to communicate with external interfaces, a router 36*c* to communicate with the hotel back office servers 18, a CD-ROM (not shown), a tape drive (not shown) and a management console.

The network operations server 36 must be able to support the required communication protocol and be flexible to support the addition of back office servers.

The network operations server 36 should also have a UPS to minimize the impact of power outage. In the event of power outage, the UPS should kick in immediately to minimize data lost.

The network operations server should also be able to test itself and be able to manage the set top boxes and the back office servers from the network operations.

The preferred network operations workstations are any 486-class PC. The purpose of the workstations is to support administration tasks and general operations. The selected laser printers must be able to print reports for different jurisdictions and the central office. The dot matrix printers should be able to print cheques for players.

TECHNOLOGY PRODUCT ALTERNATIVES

Overview

Within the spirit and scope of the invention, various technology product alternatives are envisaged. Accordingly, alternatives are described below where each alternative is made up of a Set Top Box 12, a Hotel Local Area Network 52, a Back Office System 19, a Wide Area Network 26 and a network operations Server 36. Four definable alternatives are described below which are not intended to limit the scope of the invention but provide examples of various implementation options:

Alternative 1—Video Server

Overview—A video server environment is made up of a back office server sending MPEG encoded video feeds to each room. This requires all logic to be on the back office server and the set top box to be a MPEG decoder.

Set-top—This is an intelligent micro processor based device which would receive CH 3 or CH 4 video input from the regular Set Top Box 12. It would switch to a MPEG encoded stream when utilising the gaming capabilities. The MPEG stream would enter the box from an isolated Twisted Pair cable dedicated for this function or on a selected channel. The Set Top Box 12 would support input from a credit card swipe reader 16 and from an Infrared remote control 20. These inputs would be transmitted to the back office server 18 via the UTP connection. Overall the device would have a very limited control program capable of forwarding input and output and switching between the video sources.

LAN—the Local Area Network would be made up of Twisted Pair cable connecting each room with a concentrator. Each wire segment would be capable of support either 1.5 Megabits (MPEG 1) or 6 Megabits (MPEG 2) transmission rates. The concentrator to back office server connection would have to support a transmission rate of between 150 Gigabits and 600 Gigabits through put, or be part of the server equipment or be some form of switch with the server supporting up to 250 ports. (The same functionality can be achieved by dedicating channels to each room but this would quickly utilize all of the existing channels).

Back Office Server 18—This would be a video server. This device would have to be capable of supporting 250 simultaneous video transmissions plus the application logic. It would have to be able to communicate with credit card acquirer (via modem) and to the central office server (via dial router or leased line router)

WAN 26—The Wide Area Network would either be a grouping of leased lines with 56 Kbit connections at each back office server and multiple T1 connections at the network operations server. Or the WAN 26 would be made up of dial routers with the same throughput requirements.

Network operations Server 36—This would be a standard UNIX type server capable of backing up large amounts of data and handling and inter site jackpot processing required.

Alternative 2—X-term

Overview—An X-term environment would have a set top box 12 configured as a UNIX x-terminal (Standard UNIX graphic terminal protocol). The application would run on a UNIX back office server and provide X-11 feeds to each of the terminals. This environment would act like any terminal based application and be similar to option A but with a small network band width requirement.

Set-top—This is an intelligent micro processor based device which would receive CH 3 or CH 4 video input from the regular Set Top Box 12. It would switch to a X-11 stream when utilising the gaming capabilities. The X-11 (X-term) stream would enter the box from an isolated Twisted Pair cable dedicated for this function or a shared cable channel. The Set Top Box 12 would support input from a credit card swipe reader 16 and from an Infrared remote control 20. These inputs would be transmitted to the back office server via the UTP connection. Overall the device would have a X-terminal control program capable of forwarding input and output and switching between the video sources. (Control program approximately 2x the size of alternative 1 all other set top hardware and software the same.)

LAN—The Local Area Network 52 would be made up of Twisted Pair cable connecting each room with a concentrator. Normal hub/concentrator elements could be used in this configuration with up to 50 users supported per 10 Megabit segment. The concentrator to back office server connection would have to support a transmission rate of 100 Megabits or the back office server would have to have multiple Network Interface Cards. (The same functionality can be achieved by dedicating channels to a number of rooms with each channel acting as a LAN segment).

Back Office Server 18—The Back Office Server 18 would be a standard UNIX type server. The UNIX server would be scalable to support from 50 simultaneous X-sessions up to 500 X-sessions. It would have to be able to communicate with credit card clearing houses 24 (via modem 19*c*) and to the central office server 36 (via dial router or leased line router)

WAN—The Wide Area Network 26 would either be a grouping of leased lines with 56 Kbit connections at each back office server 18 and multiple T1 connections at the network operations server 36. Or the WAN 26 would be made up of dial routers with the same throughput requirements.

Network operations Server 36—This would be a standard UNIX type server capable of backing up large amounts of data and handling and inter site jackpot processing required.

Alternative 3—Application specific Display Terminal Set Top Box

Overview—The display terminal option is similar to the X-terminal option in that the application logic exists on the back office server and the display logic is on the set top box 12. The difference is that the set top box 12 has been optimized for the specific application there by reducing the network requirement and improving performance.

Set-top—This is an intelligent micro processor based device which would receive CH 3 or CH 4 video input from the regular Set Top Box 12. It would switch to a generate video screen when utilising the gaming capabilities. The data stream, from the back office server 18, would enter the box from an isolated Twisted Pair cable dedicated for this function or on a shared cable channel. The Set Top Box 12 would support input from a credit card swipe reader 16 and from an Infrared Red remote control 20. These inputs would be transmitted to the back office server via the data connection. Overall, the device would have a graphics server responding to specific commands from the back office server 18 and capable of forwarding input and output and switching between the video sources. (Control program approximately 2x the size of alternative 1 all other set top hardware and software the same.)

LAN—The Local Area Network would be made up of Twisted Pair cable connecting each room with a concentrator. Normal hub/concentrator elements could be used in this configuration with up to 250 users supported per 10 Megabit segment. The concentrator to back office server 18 connection would have to support a transmission rate of 100 Megabits or the back office server 18 would have to have multiple Network Interface Cards. (The same functionality can be achieved by dedicating channels to a number of rooms making up a LAN segment).

Back Office Server 18—The Back Office Server 18 would be a standard UNIX type server configured for real-time transaction processing. The UNIX server would be scalable to support from 50 simultaneous sessions up to 500 sessions. It would have to be able to communicate with credit card clearing houses 24 (via modem 19*c*) and to the central office server 36 (via dial router 19*b* or leased line router 19*b*)

WAN 26—The Wide Area Network 26 would either be a grouping of leased lines with 56 Kbit connections at each back office server and multiple T1 connections at the network operations server 36. Or the WAN would be made up of dial routers with the same throughput requirements.

Network operations Server 36—This would be a standard UNIX type server capable of backing up large amounts of data and handling and inter site jackpot processing required.

Alternative 4—VLT logic in the Set-Top Box

Overview—The VLT in a Set Top Box 12 places a majority of the applications logic in the set top box. This allow the set top box to act independently except for the logging of transactions or transaction results to the back office server 18.

Set-top—This is an intelligent micro processor based device which would receive CH 3 or CH 4 video input from the regular Set Top Box 12. All application and display logic would reside in this device. The data stream, to the back office server 18, would enter the box from an isolated Twisted Pair (UTP) cable dedicated for this function or a shared cable channel and would be only for the purposes of event notification and logging. The Set Top Box 12 would support input from a credit card swipe reader 16 and from an Infrared Red remote control 20. These inputs would be interpreted by the set top box 12 and credit card requests would be forwarded to the back office server 18 for processing. Overall the set top box becomes a stand alone Video Lottery Terminal communicating with the back office system. (Control program approximately 2.5x the size of alternative 1 all other set top hardware and software the same.)

LAN—The Local Area Network would be made up of Twisted Pair cable connecting each room with a concentrator. Normal hub/concentrator elements could be used in this configuration with up to 250 users supported per 10 Megabit segment. The concentrator to back office server connection would have to support a transmission rate of 100 Megabits or the back office server 18 would have to have multiple Network Interface Cards. (The same functionality can be achieved by dedicating channels to a number of rooms to make up a LAN segment).

Back Office Server 18—The Back Office Server 18 would be a standard UNIX type server configured for real-time transaction logging and handling the jackpot processing. The UNIX server would be scalable to support from 50 simultaneous sessions up to 500 sessions. It would have to be able to communicate with credit card acquirers (via modem 19*a*) and to the central office server 36 (via dial router 19*b* or leased line router 19*b*)

WAN 26—The Wide Area Network 26 would either be a grouping of leased lines with 56 Kbit connections at each back office server and multiple T1 connections at the network operations server 36. Or the WAN would be made up of dial routers with the same throughput requirements.

Network operations Server 36—This would be a standard UNIX type server capable of backing up large amounts of data and handling and inter site jackpot processing required.

GLOSSARY OF TECHNICAL TERMS

ATM (Asynchronous Transfer Mode)—Asynchronous Transfer Mode is a high-speed packet switching technique that employs cell relay transmission. It is suitable for Metropolitan Area Networks (MANs) and broadband Integrated Services Digital Network (ISDN) transmission.

EPROM (Erasable Programmable ROM)—Reusable PROM chip that holds its content until erased under ultraviolet light. EPROMS have a lifespan of a few hundred write cycles. EPROMS are giving way to flash memory technology.

FTP (File Transfer Protocol)—A TCP/IP communications protocol that is used to log onto a network, list directories, and copy files. FTP provides full user authentication by requiring login on the remote host. It lets users transfer text and binary files, list directories on the foreign host, and delete and rename files on the foreign host. It allows users to use wild cards when specifying file transfers and to specify translation between ASCII and EBCDIC.

HUB—The point on a network where a bunch of circuits are connected. Also, a switching node. In Local Area Networks, a hub is the core of a star as in ARCNET, StarLAN, Ethernet, and Token Ring. Hub hardware can be either active or passive. Wiring hubs are useful for their centralized management capabilities and for their ability to isolate nodes from disruption.

LAN (Local Area Network)—A data transmission facility connecting a number of devices (e.g., service workstations, terminals, communications equipment, and printers), enabling the devices to share resources. This facility functions in a single building or a collection of buildings located within short distances of each other.

Modem (MOdulator-DEModulator)—Device that adapts a terminal or computer to a telephone line. It converts the computer's digital pulses into audio frequencies (analog) for the telephone system and converts the frequencies back into pulses at the receiving side. The modem also dials the line, answers the call and controls transmission speed, which ranges from 300 to 14,400 bps and higher.

ROM (Read Only Memory)—Memory chip that permanently stores instructions and data. Its contents are created at the time of manufacture and cannot be altered. See EPROM.

RAD (Rapid Application Development)—An approach to systems development that incorporates a variety of automated design tools (e.g. SDE).

Router—Computer system that routes messages from one LAN (local area network) to another. It is used to internetwork similar and dissimilar networks and can select the most expedient route based on traffic load, line speeds and costs and network failures Server—A server is any computer connected to a network of clients that services their requests and supports concurrent access by multiple-users. Typically servers run a multi-user multi-tasking operating system with support for a protected file system, process isolation, preemptive interrupt driven scheduling and virtual memory.

SDE (System Development Environment)—A set of tools, techniques, standards, procedures, models, training, materials, and documentation that helps project team members become more effective and productive in developing and maintaining application software. An SDE encompasses all of the factors that affect the development process across the full project life cycle.

SDE Application Workbench—An application that provides access to the SDE subsystems.

SQL (Structured Query Language)—The industry standard language used for referencing and accessing relational database.

TCP/IP (Transmission Control Protocol/Internet Protocol)—A set of communications protocols developed in the 1970s by the U.S. Department of Defense's Advanced Research Projects Agency (DARPA) to link dissimilar computers across many kinds of networks. It is a de facto UNIX standard but is now widely implemented and supported on almost all systems as a solution for open networking. Although committed to an eventual migration to an OSI architecture, TCP/IP currently divides networking functionality into only four layers (as compared to the seven-layer OSI model).

WAN (Wide Area Network)—A network that uses long-distance communications methods to provide communication services to a geographic area larger than that served by a Local Area Network (LAN).

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the claims.

The Embodiments of the Invention in Which an Exclusive Property or Privilege is Claimed are Defined as Follows:

1. A gaming system enabling users to participate in gaming at a plurality of remote gaming sites comprising:

a central network control center (NCC) operatively connected to a plurality of gaming locations through a wide area network (WAN), each gaming location including a back office server, the back office server operatively connected through a local area network (LAN) with a plurality of video gaming equipment in remote gaming sites, the video gaming equipment including a set-top box operatively connected to a payment device, video display means, user interface means and the back office server, the video gaming equipment enabling video gaming at each remote gaming site, wherein the back-office server includes means for receiving, securing and storing gaming transaction data during video gaming, the central network control center including means for playing a jackpot.

2. A gaming system as in claim 1 wherein the means for playing a jackpot includes means for defining a hierarchy of jackpots, the hierarchy of jackpots having a first jackpot corresponding to each gaming location and a second jackpot corresponding to a plurality of gaming locations.

3. A gaming system as in claim 2 wherein the NCC includes means for determining eligibility for winning the first and second jackpots on the basis of first and second betting thresholds respectively wherein the second betting threshold is larger than the first betting threshold.

4. A system as in claim 3 wherein the NCC further includes means for defining a third jackpot corresponding to all gaming locations within the gaming system and the NCC includes means for determining eligibility for winning the third jackpot on the basis of a third betting threshold, the third betting threshold larger than the second betting threshold.

5. A system as in claim 1 wherein the means for playing a jackpot includes means for identifying a jackpot winner by comparing a jackpot number generated by the NCC with a random number generated for a player at a remote game site during gaming.

6. A system as in claim 1 wherein the NCC includes means for generating revenue reports.

7. A system as in claim 1 wherein the NCC includes means for providing predetermined system access to a system regulator.

8. A system as in claim 1 wherein the NCC includes means for receiving daily transaction logs from each remote gaming location.

9. A system as in claim 1 wherein the NCC includes means for processing data from daily transactions logs to determine system daily revenue.

10. A system as in claim 1 wherein the NCC includes means for managing system software, the means for managing system software including program means for developing software at the NCC for use within a jurisdiction of the gaming system, program means for obtaining certification from a system regulator for software developed for a jurisdiction and program means for distributing software from the NCC to each gaming site within a jurisdiction.

11. A system as in claim 1 wherein the NCC includes means for managing system equipment, the means for managing system equipment including program means for installing gaming equipment within the gaming system wherein the gaming equipment is provided with a unique logical and physical address, program means for tracking the operational status of gaming equipment within the gaming system and program means for testing equipment wherein gaming equipment is disabled from active gaming for physical testing of the working order of the gaming equipment.

12. A system as in claim 1 wherein the NCC includes a customer support server the customer support server including means for identifying a gaming session, means for reviewing a gaming session, and means for reviewing payment transactions.

13. A system as in claim 13 wherein the NCC includes tamper resist means.

14. A system as in claim 1 wherein the NCC includes tampering recognition means for identifying tampering.

15. A system as in claim 1 wherein the NCC includes means for encrypting incoming and outgoing data.

16. A system as in claim 1 wherein the NCC includes means for supporting a variable number of back office servers.

17. A system as in claim 1 wherein the NCC includes uninterrupted power supply means.

18. A system as in claim 1 wherein the WAN includes a system regulator, the system regulator having means for accessing financial information from the central network control center.

19. A system as in claim 1 wherein the WAN includes a payment processing centre.

20. A system as in claim 1 wherein the WAN includes a bank server.

21. A system as in claim 2 wherein the NCC is a UNIX platform.

22. A system as in claim 2 wherein each back office server is a UNIX platform.

23. A system as in claim 2 wherein each back office server includes means for providing a gaming session.

24. A system as in claim 23 wherein the means for providing a gaming session includes means for controlling access to a gaming session.

25. A system as in claim 24 wherein the means for controlling access includes means for restricting access to a gaming session.

26. A system as in claim 24 wherein the means for controlling access includes means for validating access to a gaming session.

27. A system as in claim 23 wherein the means for providing a gaming session includes means for introducing a gaming session.

28. A system as in claim 23 wherein the means for providing a gaming session includes means for playing a game.

29. A system as in claim 28 wherein the means for playing a game includes means for initiating a gaming session.

30. A system as in claim 28 wherein the means for playing a game includes means for monitoring game activity.

31. A system as in claim 28 wherein the means for playing a game includes means for closing a game session.

32. A system as in claim 28 wherein the means for playing a game includes means for managing revenue.

33. A system as in claim 28 wherein the game is selected from any one of blackjack, poker or keno.

34. A system as in claim 1 wherein each back office server includes back office server tamper resist means.

35. A system as in claim 1 wherein each back office server includes tampering recognition means for identifying tampering.

36. A system as in claim 1 wherein each back office server includes means for encrypting incoming and outgoing data.

37. A system as in claim 1 wherein each back office server includes an uninterrupted power supply means.

38. A system as in claim 1 wherein each back office server includes means for receiving a payment transaction from remote gaming equipment.

39. A system as in claim 1 wherein each back office server includes means for obtaining validation of a payment transaction.

40. A system as in claim 1 wherein the video gaming equipment in remote gaming sites includes a set top box.

41. A system as in claim 40 wherein the set-top box includes logic means.

42. A system as in claim 41 wherein the logic means includes an operating system.

43. A system as in claim 41 wherein the logic means includes means for communication and equipment management.

44. A system as in claim 41 wherein the logic means includes means for graphic generation and display.

45. A system as in claim 41 wherein the logic means includes means for recognizing tampering.

46. A system as in claim 41 wherein the logic means includes means for encrypting incoming and outgoing data.

47. A system as in claim 41 wherein the logic means includes remote control signal recognition means.

48. A system as in claim 41 wherein the logic means includes payment device signal recognition means for receiving signals from the payment device and for transmitting payment device data to each back office server.

49. A system as in claim 40 wherein the set-top box communicates with the back office server via a transmission control protocol/internet protocol (TCP/IP).

50. A system as in claim 40 wherein the set-top box includes tamper resist means.

51. A system as in claim 1 wherein the gaming equipment in remote gaming sites includes a television.

52. A system as in claim 1 wherein the gaming equipment in remote gaming sites includes a payment device.

53. A system as in claim 52 wherein the payment device is selected from any one of or a combination of a credit card swipe, debit card or smart card reader.

54. A system as in claim 1 wherein the gaming equipment in remote gaming sites includes a video channel.

55. A system as in claim 1 wherein the gaming equipment in remote gaming sites includes a remote control.

56. A system as in claim 55 wherein the remote control communicates with the set-top box via an infra-red link.

57. A system as in claim 3 wherein the means for playing a jackpot includes a means for identifying a jackpot winner by comparing a jackpot number generated by the NCC with a random number generated for a player at a remote game site during gaming.

58. A system as in claim 57 wherein the NCC includes means for generating revenue reports.

59. A system as in claim 58 wherein the NCC includes means for providing predetermined system access to a system regulator.

60. A system as in claim 59 wherein the NCC includes means for receiving daily transaction logs from each remote gaming location.

61. A system as in claim 60 wherein the NCC includes means for processing data from daily transactions logs to determine system daily revenue.

62. A system as in claim 61 wherein the NCC includes means for managing system software, the means for managing system software including program means for developing software at the NCC for use within a jurisdiction of the gaming system, program means for obtaining certification from a system regulator for software developed for a jurisdiction and program means for distributing software from the NCC to each gaming site within a jurisdiction.

63. A system as in claim 62 wherein the NCC includes means for managing system equipment, the means for managing system equipment including program means for installing gaming equipment within the gaming system wherein the gaming equipment is provided with a unique logical and physical address, program means for tracking the operational status of gaming equipment within the gaming system and program means for testing equipment wherein gaming equipment is disabled from active gaming for physical testing of the working order of the gaming equipment.

64. A system as in claim 63 wherein the NCC includes a customer support server.

65. A system as in claim 64 wherein the NCC includes tampering recognition means for identifying tampering.

66. A system as in claim 65 wherein the NCC includes means for encrypting incoming and outgoing data.

67. A system as in claim 66 wherein the NCC includes means for supporting a variable number of back office servers.

68. A system as in claim 67 wherein the NCC includes uninterrupted power supply means.

69. A system as in claim 68 wherein the system regulator includes means for accessing financial information from the central server.

70. A system as in claim 69 wherein the WAN includes a payment processing centre.

71. A system as in claim 70 wherein the WAN includes a bank server.

72. A system as in claim 71 wherein the back office server includes means for providing a gaming session.

73. A system as in claim 72 wherein the back office server includes back office server tamper resist means.

74. A system as in claim 73 wherein the back office server includes tampering recognition means for identifying tampering.

75. A system as in claim 74 wherein the back office server includes means for encrypting incoming and outgoing data.

76. A system as in claim 75 wherein the back office server includes an uninterrupted power supply means.

77. A system as in claim 76 wherein the back office server includes means for receiving a payment transaction from remote gaming equipment.

78. A system as in claim 77 wherein the back office server includes means for obtaining validation of a payment transaction.

79. A system as in claim 78 wherein the video gaming equipment in remote gaming sites includes a set top box.

80. A system as in claim 79 wherein the video gaming equipment in remote gaming sites includes a television.

81. A system as in claim 80 wherein the video gaming equipment in remote gaming sites includes a payment device.

82. A system as in claim 81 wherein the payment device is selected from any one of or a combination of a credit card swipe, debit card or smart card reader.

83. A system as in claim 82 wherein the video gaming equipment in remote gaming sites includes a video channel.

84. A system as in claim 83 wherein the video gaming equipment in remote gaming sites includes a remote control.

85. A method of operating a gaming system comprising the steps of:

at a network control center operatively connected to a plurality of gaming locations through a wide area network (WAN), each gaming location including a back office server having means for receiving, securing and storing gaming transaction data during video gaming, the back office server operatively connected through a local area network (LAN) with a plurality of video gaming equipment in remote gaming sites a) establishing a first jackpot amount with a corresponding betting threshold for a gaming location;

b) establishing a second jackpot amount with a corresponding betting threshold for a plurality of gaming locations;

c) establishing a third jackpot amount with a corresponding betting threshold for all the gaming locations within the gaming system;

d) determining first, second and third winning numbers for the first, second and third jackpots;

e) distributing the winning numbers to each back office server at each gaming location; and at the gaming location f) providing gaming activity to players requesting game activity at each remote gaming site;

g) monitoring gaming activity at each back-office server to identify active players and determining the eligibility of active players for winning in accordance with the betting thresholds;

h) generating a first random number at the remote gaming site for a player during gaming and comparing the first random number with a winning number for a jackpot at a remote gaming site for a player to determine a winning player if the first and second random numbers are the same;

i) transmitting a message from the network control center to a winning player informing the winning player of a win.

86. A gaming system enabling users to participate in gaming at a plurality of remote locations comprising:

a plurality of local area networks (LAN's) for communication with a network operations server and a payment processing center through a wide area network (WAN), each LAN including:

a plurality of set top boxes in remote locations, each set top box for communication with a back office server and respective televisions, remote control units, and payment swipe devices;

wherein the back office server includes program means for enabling interactive video gaming between a user and the television using the remote control unit wherein credit for said interactive video gaming is activated through the payment swipe device and approved by the payment processing center through the WAN and where the network operations server is for communication with each LAN and for communication with the payment processing center and wherein the back-office server also includes means for receiving, securing and storing gaming transaction data during video gaming.

87. A gaming network enabling users to participate in gaming at a plurality of remote locations comprising:

a plurality of local area networks (LAN), each LAN including a back office server, the back office server having video gaming software and means for receiving, securing and storing gaming transaction data during video gaming and a plurality of distributed gaming units, each gaming unit including:

a set-top box operatively linked to a payment device and display means at a remote location;

the set-top box also in operative communication with the back office server, the set-top box for controlling a gaming session with a user via signals received from the payment device, user and back office server, the back office server for controlling and maintaining each gaming unit;

a wide area network operatively linking the back office server of each LAN to a central server, the central server for controlling and maintaining each LAN.

88. A gaming network as in clam 87 wherein the WAN includes a payment processing server operatively connected to each LAN and the central server.

89. A gaming network as in claim 87 wherein the WAN further includes a customer support server operatively connected to the central server and each LAN.

90. A gaming network as in claim 87 wherein the WAN further includes a monitoring server operatively connected to the central server.

91. A gaming system as in claim 88 wherein the WAN further includes a bank server operatively connected to the payment processing [centre] server and central server.

92. A gaming system enabling users to participate in gaming at a plurality of remote gaming sites comprising:

a central network control center (NCC) operatively connected to a plurality of gaming locations through a wide area network (WAN), each gaming location including a back office server operatively connected through a local area network (LAN) with a plurality of video gaming equipment in remote gaming sites, the video gaming equipment including a set-top box operatively connected to a payment device, video display means, user interface means and the back office server, the video gaming equipment enabling video gaming at each remote gaming site, the central network control center including means for playing a jackpot wherein the NCC includes means for providing predetermined system access to a system regulator.

93. A gaming system enabling users to participate in gaming at a plurality of remote gaming sites comprising:

a central network control center (NCC) operatively connected to a plurality of gaming locations through a wide area network (WAN), each gaming location including a back office server operatively connected through a local area network (LAN) with a plurality of gaming video equipment in remote gaming sites, the video gaming equipment including a set-top box operatively connected to a payment device, video display means, user interface means and the back office server, the video gaming equipment enabling video gaming at each remote gaming site, the central network control center including means for playing a progressive and hierarchal jackpot.

94. A gaming system enabling users to participate in gaming at a plurality of remote gaming sites comprising:

a central network control center (NCC) operatively connected to a plurality of gaming locations through a wide area network (WAN), each gaming location including a back office server operatively connected through a local area network (LAN) with a plurality of gaming video equipment in remote gaming sites, the video gaming equipment including a set-top box operatively connected to a payment device, video display means, user interface means and the back office server, the video gaming equipment enabling video gaming at each remote gaming site, the central network control center including means for playing a jackpot and wherein the WAN includes a system regulator, the system regulator having means for accessing financial information from the central network center.

95. A gaming system enabling users to participate in gaming at a plurality of remote gaming sites comprising:

a central network control center (NCC) operatively connected to a plurality of gaming locations through a wide area network (WAN), each gaming location including a back office server operatively connected through a local area network (LAN) with a plurality of gaming video equipment in remote gaming sites, the video gaming equipment including a set-top box operatively connected to a payment device, video display means, user interface means and the back office server, the video gaming equipment enabling video gaming at each remote gaming site, the central network control center including means for playing a jackpot wherein the WAN includes a system regulator, a payment processing server and a bank server operatively connected to the NCC.

* * * * *